US006461064B1

(12) United States Patent
Leonard et al.

(10) Patent No.: US 6,461,064 B1
(45) **Date of Patent: *Oct. 8, 2002**

(54) SERVICE STATION ASSEMBLY FOR A DRUM-BASED WIDE FORMAT PRINT ENGINE

(76) Inventors: Benjamin Patrick Leonard, 544 Portland Ave. #3, St. Paul, MN (US) 55102; Michael David Hanson, 5600 138 St. West, Apple Valley, MN (US) 55124; Kerry Ray Anderson, 17353 Faraday Ct., Farmington, MN (US) 55024; Gregg Michael Bloom, 7761 53rd St. North, Lake Elmo, MN (US) 55042

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/042,769

(22) Filed: Mar. 17, 1998

Related U.S. Application Data

(63) Continuation-in-part of application No. 08/711,796, filed on Sep. 10, 1996, now Pat. No. 5,871,292.

(51) Int. Cl.[7] ..... B41J 19/20

(52) U.S. Cl. ..... 400/328; 400/320; 400/352; 347/33

(58) Field of Search ..... 400/328, 320, 400/352, 175; 347/33, 15

(56) References Cited

U.S. PATENT DOCUMENTS

| | | | | | |
|---|---|---|---|---|---|
| 4,613,245 | A | * | 9/1986 | Ikeda et al. | 400/328 |
| 4,827,282 | A | * | 5/1989 | Ritchie | 346/1.1 |
| 5,276,459 | A | * | 1/1994 | Danzuka et al. | 346/33 A |
| 5,276,466 | A | * | 1/1994 | Tsukaa et al. | 346/139 R |
| 5,402,156 | A | * | 3/1995 | Donahue et al. | 346/139 |
| 5,440,331 | A | * | 8/1995 | Grange | 347/33 X |
| 5,455,608 | A | * | 10/1995 | Stewart et al. | 347/23 |
| 5,585,826 | A | * | 12/1996 | Schroeder et al. | 347/33 X |
| 5,644,347 | A | * | 7/1997 | Schwiebert et al. | 347/33 |
| 5,801,725 | A | * | 9/1998 | Neese et al. | 347/33 X |

FOREIGN PATENT DOCUMENTS

JP 6-191060 7/1994

* cited by examiner

*Primary Examiner*—Andrew H. Hirshfeld
*Assistant Examiner*—Minh Chau
(74) *Attorney, Agent, or Firm*—Carmody & Torrance LLP

(57) ABSTRACT

This invention relates to an improved wide format color digital print engine, and in particular to a drum-based large format digital ink jet print engine having a vertically articulated carriage portion which carries both the print heads and an imaging array, adjustable saber angles for print heads, a novel service station, and an extremely robust weight-bearing carriage architecture. In particular, the present invention provides a highly manufacturable print engine benefiting from a discrete few controlled mounting locations so that accurate mounting of the cooperating sub-assemblies allow a very stable carriage assembly for driving said carriage laterally with respect to a printing medium coupled to the exterior of a drum.

1 Claim, 18 Drawing Sheets

WORST CASE POSITIONAL ERROR
WITH .5" PITCH LEAD SCREW

WORST CASE POSITIONAL ERROR
WITH .1" PITCH LEAD SCREW

SERVICE STATION ASSEMBLY FOR A DRUM-BASED WIDE FORMAT PRINT ENGINE

Cross Reference to Related Application

This application is a continuing application (continuation-in-part) of Ser. No. 08/711,796 filed Sep. 10, 1996 now U.S. Pat. No. 5,871,292 and entitled "Cooperating Mechanical Sub-Assemblies for a Drum-Based Wide Format Digital Color Print Engine."

FIELD OF THE INVENTION

This invention relates to the field of wide format color digital printing systems, and in particular to an improved drum-based ink jet printer having a novel service station for precisely cleaning and storing a plurality of marking elements associated with ink emitting print heads. The present invention finds use in the digital printing and imaging industry where successful repeatable printing requires precise placement of dots on print substrates including paper, vinyl, film, and other print substrates of varying thickness that typically include emulsion coatings thereon to promote consistent interaction with printing media marking materials such as ink, toner, or various printing compounds.

BACKGROUND OF THE INVENTION

The present invention relates to an improved apparatus for supporting, driving, maintaining, and operating print heads coupled to a carriage across a printing media so that ink droplets may be placed thereon to reproduce text and images with precision. Prior art mechanisms for driving a print carriage typically utilize a belt and pulley actuated mechanism or helical gear attached to the print carriage. These prior art carriage mounting and drive systems are known to cause errors in printed output.

Prior art print head rail members for large format print engines further encounter limitations due simply to the length and mass of a typical rail, carriage drive means, and carriage assembly as well as mechanical control difficulties related to precisely controlling all the specifications and tolerances during manufacturing and installation. A phenomena described as "tolerance stacking" contributes a significant component of error in an assembly process wherein at least two precision machining events occur at differing times on the same assembly or same time for different assemblies. In relation to a carriage assembly for a large format print engine, such tolerance stacking occurs at a number of discrete points of manufacture. For example, a carriage typically precisely supports at least one, and oftentimes several, print heads, a portion of the circuitry for such print heads, and all intervening means for driving the carriage assembly upon a guideway or track in a highly controlled manner (e.g., belts, pulleys, gears, encoders, motors, etc.). Thus, machining portions of subassemblies to arrive at an exact location of the print head(s) relative to: other print head(s), the printing medium, and the rail assembly can all contribute positional error relative to a design criteria possessing rigorous tolerance specifications. Prior art carriages typically couple to opposing sides of a single rail and often include a driving force to both impart axial motion and to constrain movement of the carriage. The inventors believe that using an attachment point for driving a carriage causes errors in the locations of ink droplets on the paper as described hereinbelow.

Additional problems with prior ink jet head configurations involve the mounting of the print head for accurate placement and movement across the printed image. The rail structure for the print head must adequately support the print head not only over the entire printed image, but also for any cleaning, maintenance, and temporary storage of the print heads. It is common to provide a zone, away from the printing medium within which to "park" the print head to perform auxiliary "service" functions, this zone is commonly known as a service station. These auxiliary functions may include manipulating the carriage, certain calibration functions, cleaning and capping of the print heads. To accommodate the park zone, the support system, or rails, must support the head over a distance greater than the width of the printing medium. For example, printers handing printing medium about 36 inches wide may have rails about 48 inches long.

Accurate placement and movement of the print head becomes more and more difficult as the length of the print scan (i.e., the width of the image) increases. Most prior ink jet printers over about 17 inches wide employ either a two-rail structure, or a single-rail and outrigger structure, for head carriage X-directional travel. Both of these techniques provide two separate and independently adjustable support points for the carriage. Multiple support systems were used on wide format printers because it was believed that a single rail could not provide adequate support and stability for the print head over a large distance. Multiple support systems were utilized to provide a wider support base for the print head and carriage to lessen the effect of any stability problems, as well as to provide additional strength to lessen rail flexing problems. Vibration problems may occur if the print head undergoes movement with respect to the rail structure. The print head may slightly rotate or shake about an axis parallel to the rails, causing the print head placement with regard to the paper surface to be inaccurate. Alternatively, the print head may slightly rotate or shake from side to side on the rails, perhaps due to the direction of print head travel.

Dual support systems have not proven to be altogether feasible for graphics quality large format printing because it is generally difficult to maintain parallelism of the supports across the entire width of the large format media and oftentimes either more or less than three discrete points constrain the carriage. More particularly, each support introduces positional error, resulting in non-parallel guide paths for the carriage. Further, prior art two-rail systems employ a pair of circular rails, with the print head mounted on a carriage which is in turn mounted on the rails. The carriage is generally supported by circular sets of ball bearings wrapped around each of the circular rails. Non-parallelism of the rails introduces vibration through the ball bearings to the carriage, often causing instantaneous horizontal velocity errors. If the supports are not parallel, the rollers on the carriage will bind or have excess freedom at particular locations along the rails, and cause further stability and vibration problems. If bending of the rails occurs and the railings are not maintained completely straight, errors occur in positioning the print head. Additional problems occur due to the space that the rails take up, interfering with the transfer of electronics and ink from the printer housing to the print head. It will be appreciated that these problems are magnified as the length of the rail or rails becomes greater, as in large-format printing. Accordingly, a print head configuration is desired which will avoid these various problems.

Furthermore, such prior art carriage and drive systems typically are not designed for in-field replacement with minimum personnel and requiring a minimum amount of service time. In fact, due to the obvious competing design objectives of mechanical positional accuracy and field replacement convenience, the inventors are aware of only one other such rail system offering similar design benefits as the present invention. The inventors refer to U.S. Pat. No. 5,592,202, issued Jan. 7, 1997 and titled "Ink Jet Printer Rail Assembly" which application is commonly assigned with the present invention to ColorSpan Corporation (formerly known as LaserMaster Corporation) of Eden Prairie, Minn. 55344. In the application cited, a single rail pivotably attaches to at least one end of a print engine chassis so that the carriage riding thereon may be removed for field service and replacement. The benefits of such a system relate to diminished down-time, reduced required service, and efficient repairs, thereby reducing the overall cost of ownership involved in operating one or more large format digital print engines.

Prior art digital printing systems typically operate by moving a print medium transverse to an articulated imaging print head. The print head frequently includes a plurality of discrete imaging elements suitably arranged in a pattern wherein one or more linearly aligned sets of ink emitting nozzles, or jets, disposed perpendicular to the direction of movement of the printing substrate for providing maximum coverage. The net result is that discrete dots are placed on precise locations on the printing media so that a pleasing visual image is rendered upon the printing media. However, as the number of print heads (and therefore jets) increases registration among the different print heads become more complex at the same that it becomes more crucial to the quality of the printed output formed by the printer. A picture element or pixel generally refers to a coverage area on the print media (or a sensing element in an imaging array) defined by resolution in a "vertical" direction relative to a "horizontal" direction. These pixels must be controlled very carefully to impart desired quality of the image, and the physical and chemical interaction between the marking material and the printing media and the environmental conditions under which the marking material is deposited upon the printing media all contribute to the quality of the actual image rendered. In fact, due largely to media characteristics, the inventors prefer to utilize a single pass printing mode wherein all the image pixels are formed in a single pass of the carriage assembly over the printing substrate to avoid such problems.

Most digital print engines that typically use one or more of a subset of the four subtractive primary colors: cyan, magenta, yellow, and black ("CMYK") and rely upon color blending of these four ink colors to achieve accurate representations of desired color(s). Upon combining ink colors at a given pixel that a particular color combination can be formed by having multiple ink colors at a particular pixel location, either in a dot-on-dot or a dot-next-to-dot configuration. In sum, digital printing processes involve precisely placing a number of tiny dots onto particular locations on a printing medium. Any number of these small dots, when viewed some distance away from a printing medium such as film or paper, are perceived as a continuous-tone visual image and means for registering the dots is crucial, although only x-y registration was heretofore available. Thus, it can be appreciated that even slight variance in the actual positional location of the ink dots can significantly effect the overall visual impression created by the printed image. In one subset of digital printing technology, aqueous ink is expelled from a plurality of ink jet nozzles to form dots on the printing media via thermal, piezoelectric, acoustic, and other technologies used for reliably ejecting a tiny droplet of ink onto a printing substrate. This is known as "ink jet" printing and its popularity and the innovation related thereto have greatly increased the accuracy and therefore the photorealistic quality of the images printed, while at the same time attempting to lower the costs of ownership as larger and larger wide format print engines are commercially introduced. While the types and numbers of inks, and ink jet cartridges, usable with such printers have increased thereby increasing the complexity of controlling interaction among the inks, cartridges, and printing medium, reduced costs of ownership and ease of serviceability continue to drive a large amount of innovation in this field of endeavor. Thus, a continued need exists in the art for low cost and at the same time technically advanced, highly accurate means of performing wide format color digital ink jet printing.

SUMMARY OF THE INVENTION

The reader is encouraged to cross reference and review the present document with a number of [now allowed] U.S. patent applications, each filed on Sep. 10, 1996, each commonly assigned, and the contents of each are hereby incorporated by reference in their entirety herein; specifically, U.S. patent application Ser. No. 08/711,796 entitled "Cooperating Mechanical Sub-Assemblies for a Drum-Based Wide Format Digital Color Print Engine;" U.S. patent application Ser. No. 08/709,803 "Calibration and Registration Compensation Method for Manufacturing a Drum-based Print Engine;" U.S. patent application Ser. No. 08/709,804 "Method for Manufacturability of a Low Cost Printing Drum;" U.S. patent application Ser. No. 08/709,803 "Method and Apparatus for Compensating for Faulty Ink Emitting Elements in a Digital Output Device;" and U.S. patent application Ser. No. 08/711,815 "Method of Selecting an Ink Set of an Ink Jet Printer." Furthermore, applicant herein incorporates by reference U.S. patent application Ser. No. 08/922,297 "Method and Apparatus for Registration and Color Fidelity Control in a Multihead Digital Color Print Engine" which was filed on Sep. 3, 1997; U.S. Pat. No. 5,369,429 titled "Continuous Ink Refill System for Disposable Ink Jet Cartridges Having a Predetermined Ink Capacity;" and U.S. Pat. No. 5,469,201 directed to a guideway for a continuous ink refill system, all three of which are also commonly owned by the present assignee.

The present invention relates to a low cost, large format print engine featuring field replaceable subassemblies such as: a carriage having a vertically-articulated articulated portion (which retains a plurality of print heads and an imaging sensor array) and carriage drive means preferably comprising a combination rail and mechanically isolated lead screw assembly, a motor to both drive a printing drum and provide reliable means for monitoring and controlling drum rotation, two electronics subassemblies—a first for operating the printing system software (disposed in an electronics bay), and a second for handling all print related image data management and printing operations (disposed on the carriage assembly), and a service station subassembly for cleaning and maintaining a plurality of ink jet cartridges operating in said large format ink jet print engine. The print engine described with reference to preferred embodiments herein solves prior art difficulties and offers a new series of low-cost accurate wide format print engines. The print engine of the present invention contains a CD-ROM reader, hard drive, and Intel Pentium Processor chip and related circuitry so that relatively complex large format digital color computerized printers as described and enabled herein may be reliably and simply fabricated, operated, and serviced and thereby producible in high volume at reduced cost making ownership of such machines less expensive overall. Some of the key advantage of a print engine taught herein include; a two stage carriage assembly having a vertically articulated portion housing ink jet print heads and preferably an optical imaging array; an extremely resilient three-point (planar) stance where the carriage assembly rides on the printer rail structure; a mechanically-isolated attachment to a lead screw drive means; and an improved service station assembly.

The improved drum-based printer of the present invention again utilizes virtually no critical parallel alignments; in that the inventors have again implemented a pair of complementary alignment plates that are virtually impervious to errors during manufacture and which posses extremely robust behavior in almost every orientation. In fact the two alignment plates of the present invention must practically be physically bent, or grossly out of relatively parallel alignment before any of the sub-assemblies of the present invention are affected. Thus, the alignment plates handle a great deal of chassis movement without deleterious effects on the head height relative to the print medium.

The present invention may be performed with most types of large format digital print head technologies since the characteristics of the print head are more or less independent of the manner in which a carriage for conveying a print head or heads across a print media to create a large format digital image. Thus, the present invention encompasses a carriage assembly which supports the print heads in close proximity to a print medium via a vertically articulated portion of the carriage assembly and couples to a helical lead screw member at a mechanically isolated engagement point to reliably control the transverse motion of the carriage relative to the printing medium.

In a preferred embodiment, the carriage contacts three support points, thereby forming an extremely stable planar foundation from which deflection is unlikely and is not supported but is rather only driven via engagement at a single drive location by a novel, spring-biased helical lead screw for reliably propelling the carriage with a minimum of resistance. In this embodiment, the drive location is preferably spring-biased to one side of the grooves that form the driving portion of said lead screw and provided with a single-degree of freedom spring-biased attachment subassembly. This attachment subassembly imparts an axial force that absorbs a surprisingly large amount of non-axial vibration and movement, which are potential sources of tracking error for the entire carriage assembly particularly when the lead screw reverses rotation. Furthermore, the three-point stance and minimal rolling resistance absorbs an unprecedented amount of force without deflection. Thus, heavy pre-printing, printing, or post-printing assemblies and associated electronics can be easily accommodated with this design. Also, the service station assembly has an independent suspension for all "stations" and uses the print heads themselves for guidance accuracy during service station operation. Finally, the vertically articulated print heads can adjust to accommodate myriad printing substrates of vastly differing thickness.

The following drawings are representative only and as such should be viewed as illustrative and not limiting to any particular embodiment of the present invention or of any relative scale of the features depicted therein.

DETAILED DESCRIPTION OF THE PREFERRED EMBODIMENTS

Figure 1:
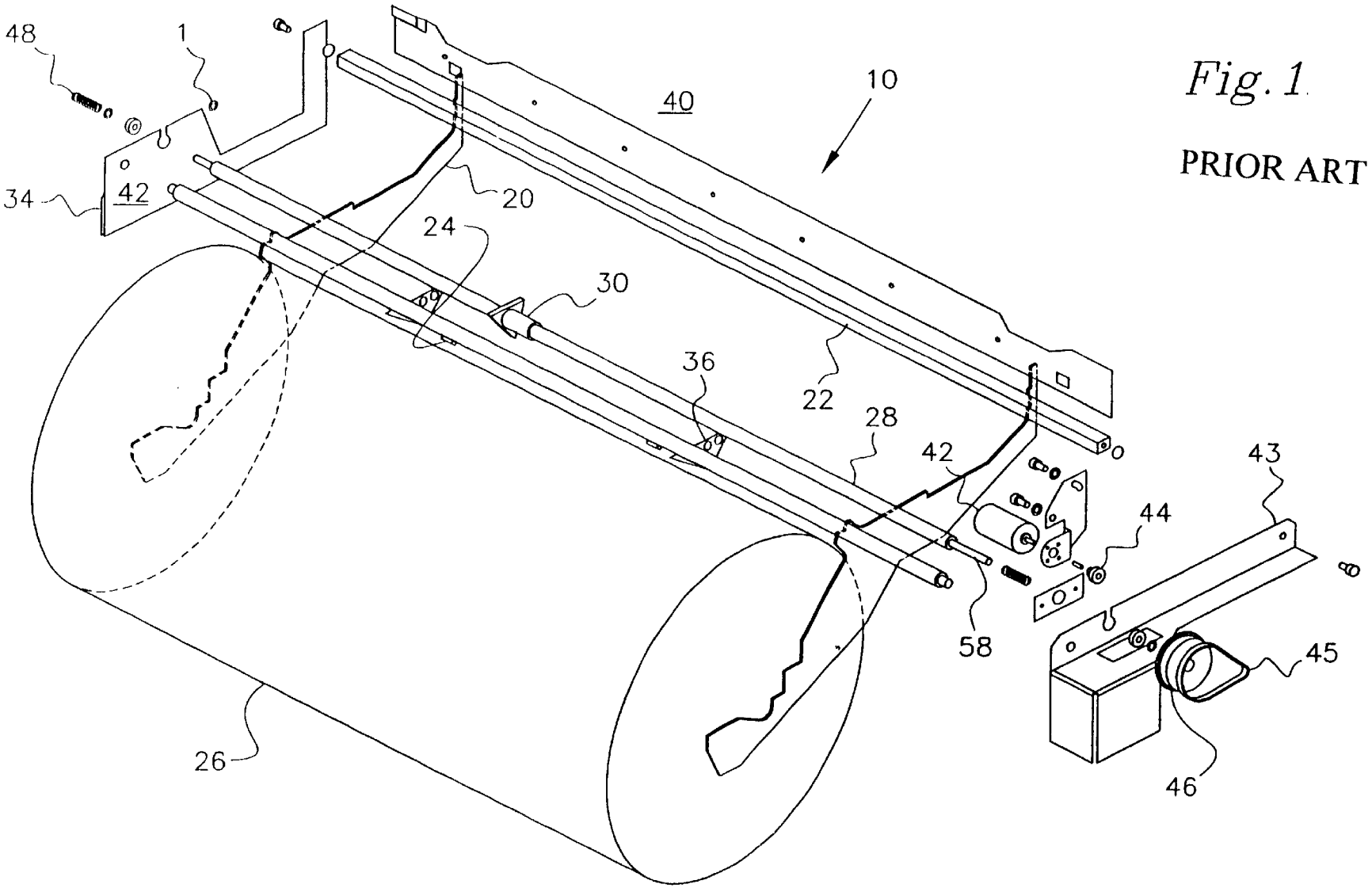
Fig. 1 PRIOR ART
FIG. 1 is an exploded perspective view of a supporting and drive assembly for a prior art drum and rails assembly.
Figure 2:
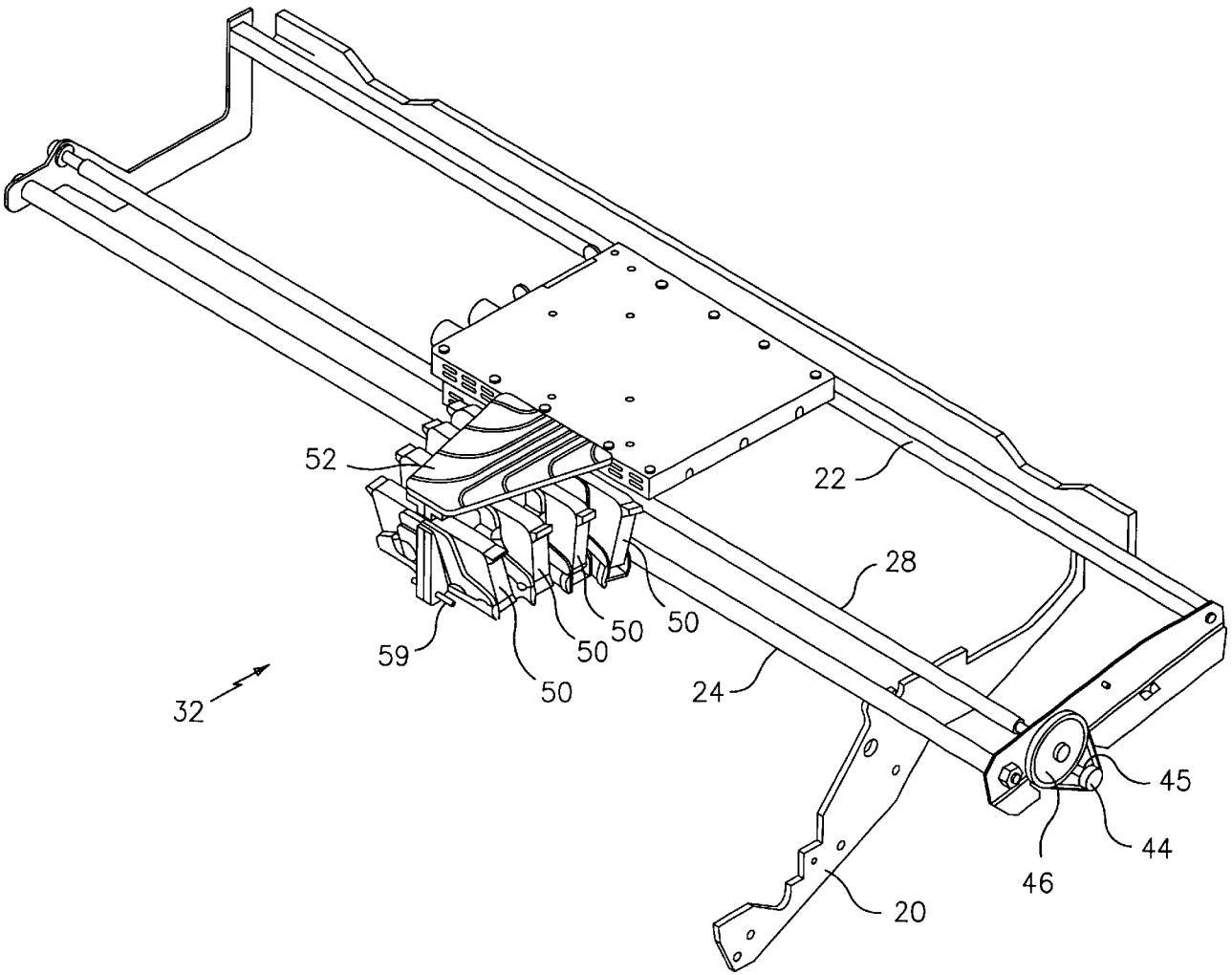
FIG. 2 is a perspective view of an embodiment of a carriage assembly for releasably retaining eight ink jet cartridges in close proximity to a printing medium attached to a rotating drum member and using the rail apparatus of FIG. 1.
Figure 12B:
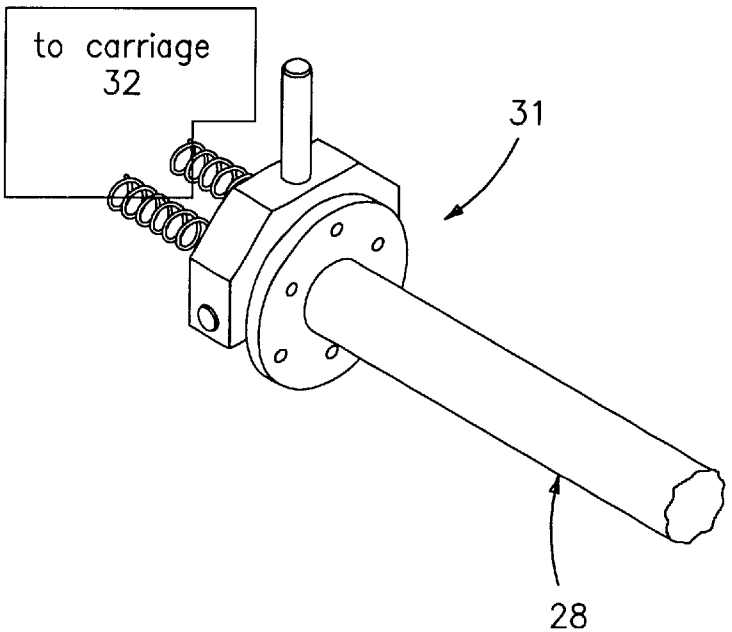
FIG. 12A and FIG. 12B depict an exploded view and an assembled view, respectively, of a biased attachment nut for mechanically isolating a driving force provided by a lead screw.
Figure 12A:
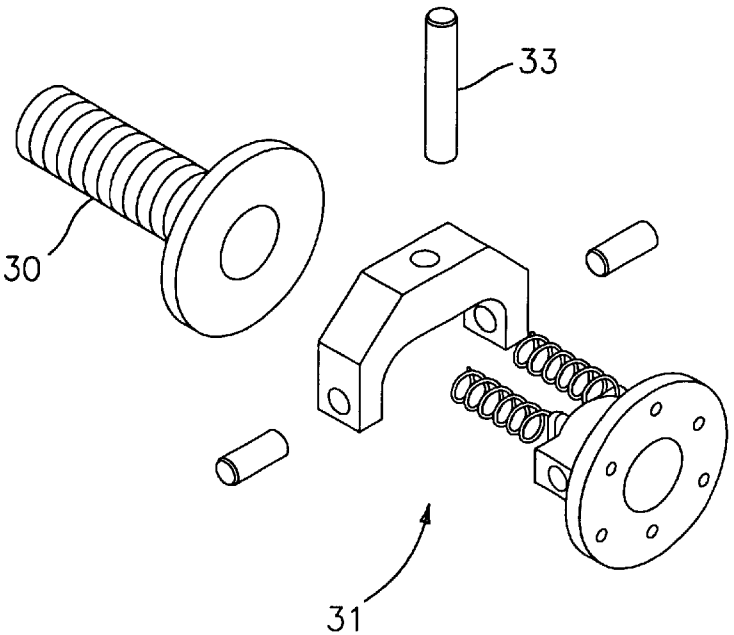
Figure 16:
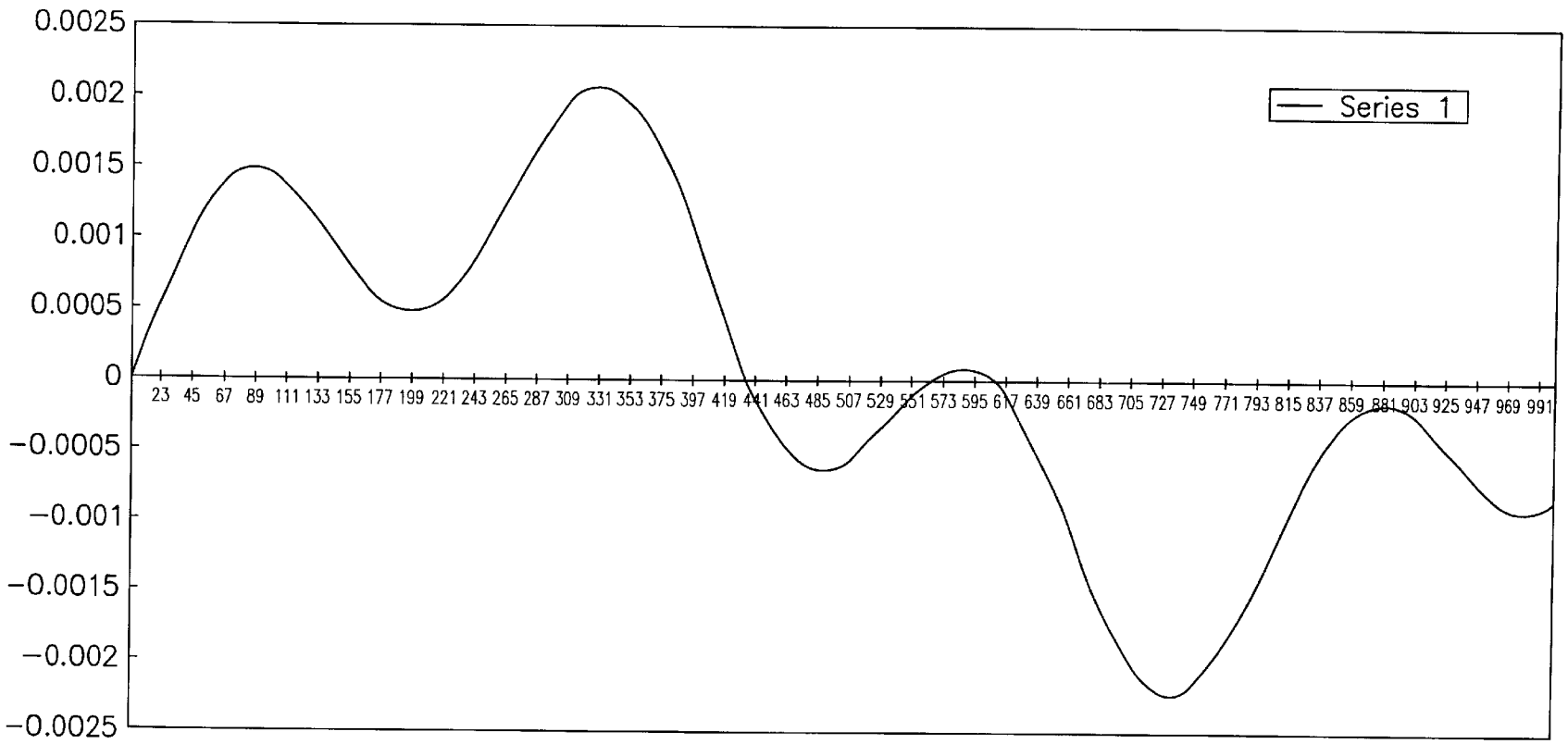
FIG. 16 is a graph depicting a worst case scenario of positional error related to a lead screw having a 0.5 pitch per revolution.
Figure 17:
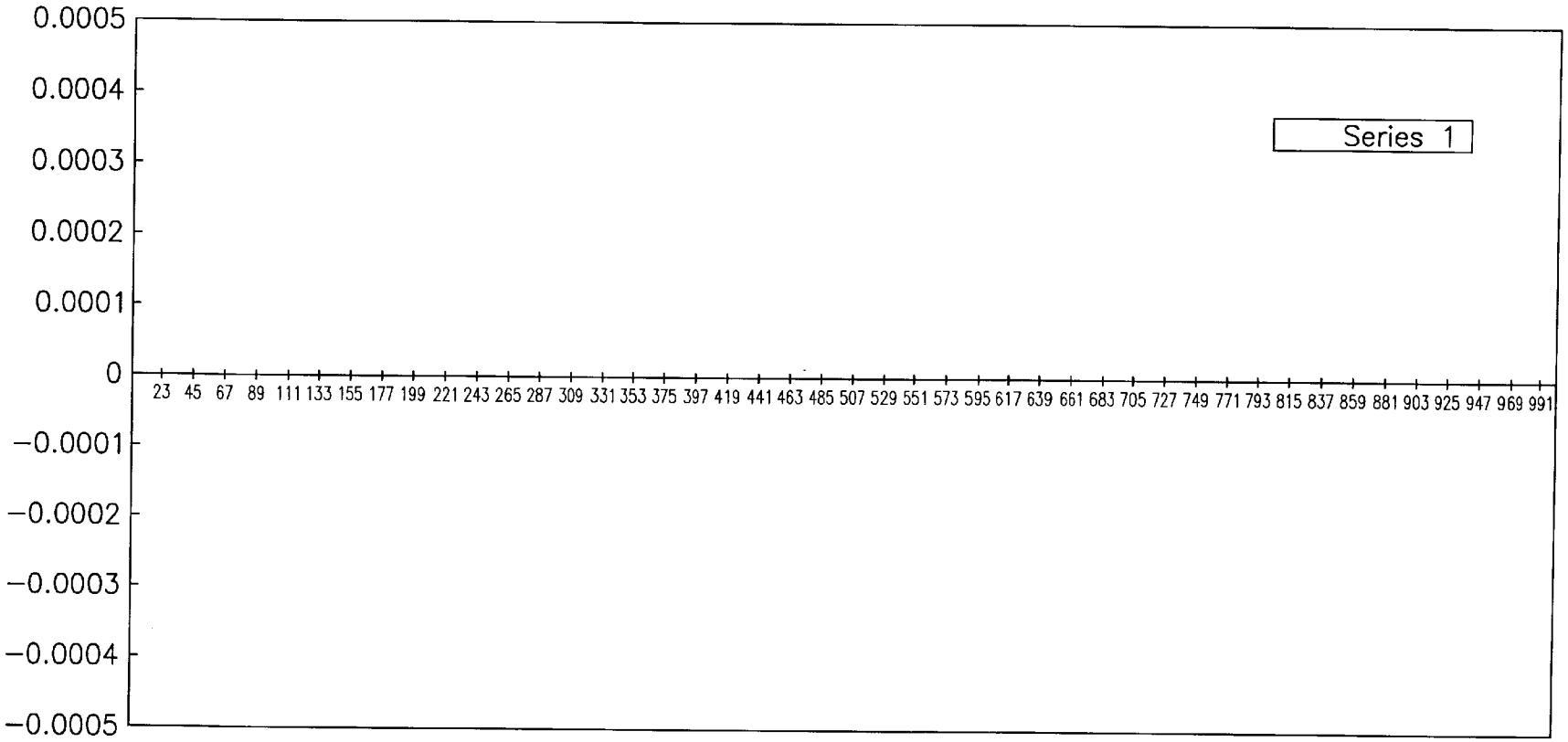
FIG. 17 is a graph depicting a worst case scenario of positional error related to a lead screw having a 0.1 pitch per revolution.

An apparatus for reliably and precisely propelling a print carriage 32 along print rails 22,24 proximate a rotating drum 26 thus forming a low cost high precision printer 40 containing many field replaceable sub-assemblies is disclosed and taught herein. Referring to FIG. 1 depicting key elements of a prior art rail and carriage drive assembly useful with the present invention as typically disposed within suitable print engine chassis housing 1 two alignment support plates 20 oriented at either end of rail assembly 10 and mechanically coupled to only the components whose alignment relative to one another is critical to print operations; namely, bar rail 22, shaft rail 24, and drum 26 (FIG. 1). Lead drive screw 28 engages linear actuator 30 which is preferably an anti-backlash lead screw nut 31 biased in the axial direction parallel to said lead screw 28 and attached to intermediate assembly nut 31 (FIG. 12A and FIG. 12B) and with one or more sources of bias (e.g., springs, magnets, electronic circuits, switches, resin-based straps, etc.) connected to a lower portion of a carriage assembly 32, to provide a single degree of freedom mechanism, so that as lead screw 28 rotates, the linear actuator 30 propels along the axis of lead screw 28 in proportion to the rate of rotation of lead screw 28 with tolerance for tracking error of said lead screw 28 relative to carriage assembly 32. Linear actuator 30 preferably self lubricates and requires no maintenance whatsoever during its intended service life. Lead screw 28 preferably comprises a two start, or dual thread path, lead screw, pitched relative to vertical such that the linear actuator 30 travels less than one half inch (0.5) in an axial direction for every complete rotation of the lead screw 28 and preferably approximately one tenth of one inch (0.1) to significantly decrease transmission of drive train errors to the ultimate location of the ink droplets on the printing substrate (see FIG. 16 and FIG. 17 which depict positional error between 0.5 and 0.1 pitch lead screw). Lead screw 28 furthermore is sized to appropriately handle the drive load of the carriage assembly 32 (shown in FIGS. 4–9) such that in one embodiment the diameter of lead screw 28 is three quarters of an inch (¾"). The reason for this choice of diameter relates to the fact that encountering a natural frequency during driving of a lead screw will cause many vibration errors detrimental to quality digital printing. The nut assembly 31 has an upwardly extending dowel-like pin 33 for engaging a corresponding not shown aperture formed on a lower surface of the carriage 32 and a rotational axis orthogonal to said pin 33, which is loosely constrained with two pins to ease assembly, removal, and reconnection of the carriage 32 to a first two start connector 30 via said nut assembly 31 and ultimately lead screw 28.

Bar rail 22 preferably mechanically couples at a distal end of a carriage assembly 32, where a set of opposing low friction rollers (not shown) contacts opposing sides of the polished exterior surface of bar rail 22. In addition, a spring provides a biasing force to the rollers to the sides of bar rail 22 so when an upward force is received from service station capping (see below) the carriage assembly does not fail to engage the rail. The carriage assembly 32 similarly contacts two locations of the shaft rail 24 so that a stable three-point support orientation which retains the carriage assembly 32 in a stable, but not overly-constrained, secure manner. Lead screw 28 is preferably disposed at a center of resistance of the carriage assembly with respect to the aggregate components of drag induced by the sliding action of the carriage 32 at bar rail 22 and shaft rail 24 thus promoting an evenly distributed propelling force that inherently reduces jitter and other oscillation of the carriage during printing operations.

Carriage assembly 32 mechanically couples to shaft rail 24 around a majority portion the circumference of cylindrical shaft rail 24 (as shown with arrow denoted with reference numeral 25) such that the carriage assembly 32 is disengageable from bar rail 22 by loosening three screws that connect nut assembly 31 to actuator 30 and sliding the peg 33 out of the aperture formed on the lower portion of the carriage 32. To remove the carriage assembly 32 from shaft rail 24 by loosening the bearing that forms a partial radius connector and sliding it axially until it is clear of the carriage assembly 32. Then an operator may simply lift the carriage assembly 32 from its supported position from the rail(s) 22,24.

At each end of lead screw 28 where it connects to ancillary supports 42,43 ballast 34 can be added to counteract the naturally sagging the occurs in a length of periodically supported rail, such as used in the present invention. Thus, even though the shaft rail 24 is supported upon the two alignment support plates 20 and at approximately two additional locations upon adjustable bracket supports 36, the ballast 34 operates to eliminate sagging (during initial fabrication only ) and maintain shaft rail 22 straight and parallel to bar rail 24, which is supported along a majority of its length directly upon a support plate rigidly fastened to the rear of the enclosure 40. Lead screw 28 furthermore preferably is spring biased at one end (either 48 or 58) to help ensure uniform and reproducible motion of actuator 30 for every repetition of axial movement of actuator 30, and therefore, to a large degree, carriage assembly 32.

A drive mechanism for lead screw 28 consists of a low torque motor, which must ultimately move the carriage assembly 32 which itself requires a minimum of approximately 8 in/ounces of torque to move the carriage assembly, driving a timing belt and pulley 44 coupled to a spring tensioned timing belt 45 further coupled to gear 46, spaced apart from pulley 44, which is in turn coupled to an end 48 of lead screw 28. Low torque motor 42 is electrically coupled to suitable motor control circuitry to drive the pulleys 44,46 and therefore lead screw 28, precisely during printing operations and periodic service station visits (as described elsewhere herein). In addition, a similar low-torque motor can be used to drive the drum 26 into stable rotation. In a preferred embodiment, said low torque motor 42 comprises an analog stepper motor driven by two analog voltage inputs to achieve rotation and wherein an optical encoder is provided that generates a count value as the lead screw 28 rotates. This rotational counter is correlated to the axial slewing distance of the carriage assembly 32, and at least one calibration value of optical encoder counts correlated to a known slewing distance is stored in flash memory in the associated circuitry of the engine 40 as described hereinbelow Another aspect of the present invention is that positional error or other defect in the spacing, sizing, or pitch of the lead screw 28 can be accurately eliminated during a calibration sequence following assembly of a print engine. The sequence involves printing two dots at a desire spacing, then measuring the spacing with an object standard, comparing the measurement to the desired spacing (i.e., maximum print swath end points) and then providing a calibration input signal to the rotary motor 42 driving the lead screw 28. Thereafter, the rotary motor 42 utilizes an initial nominal counter calibration input signal value (stored in flash during initial assembly) which drives the carriage 32 a known distance (e.g., 36").

Following initial fabrication of the engine 40, and subsequently after major service to drive components of said engine 40, a calibration sequence is run as follows: A first and a second discrete printed mark is printed with a command for a desired separation between said marks (using the value stored in the flash memory). The separation between the first and the second mark is measured using highly accurate measuring instrument capable of resolution on the order of the print head resolution. If the desired and the actual separations differ, the value stored in the flash memory is replaced with a new counter value corresponding to the exact distance. This method reduces error for a typical low cost lead screw as preferably used herein from approximately 20 mils per yard (0.020"/36") to less than two mils (<0.002"). This calibration sequence can be implemented following replacement or repair of any sub-assembly involved in translating the carriage assembly 32 laterally during printing and servicing operations.

A service station assembly 200 as disclosed and enabled herein operates to clean and maintain the print heads intermittently during sustained print operations and during temporary storage, for example, overnight. Notably the service station subassembly 207 also mechanically releasably couples directly to alignment supports 20 so that the relative parallel alignment among the drum surface axis (and therefore surface) and the service station assembly 200 (shown in detail in FIG. 9) remains intact. The carriage assembly 32 meets lead screw 28 at interface 29 (which receives actuator 30 and biased nut assembly 31) and the shaft rail 24 meets the carriage at the location denoted by the reference numeral 25 (arrow 25). This design provides for robust weight-bearing performance of the carriage assembly 32 since it can accommodate approximately 200 pounds of downward force without significant deflection, even through the design is essentially a cantilever. Thus, the carriage assembly 32 can accommodate and carry a variety of printing implements of varying size and weight. For example, a source of ultra-violet (UV) or infrared (IR) radiation *or other sources of post-print processing energy), significantly all electronics for the printer, or even an extended ink supply could be carried on the carriage assembly 32 of the present invention without degrading performance of said carriage. Of course, a suitably rated motor 42 for propelling the carriage assembly 32 would be required to practice this form of the invention.

Figure 13:
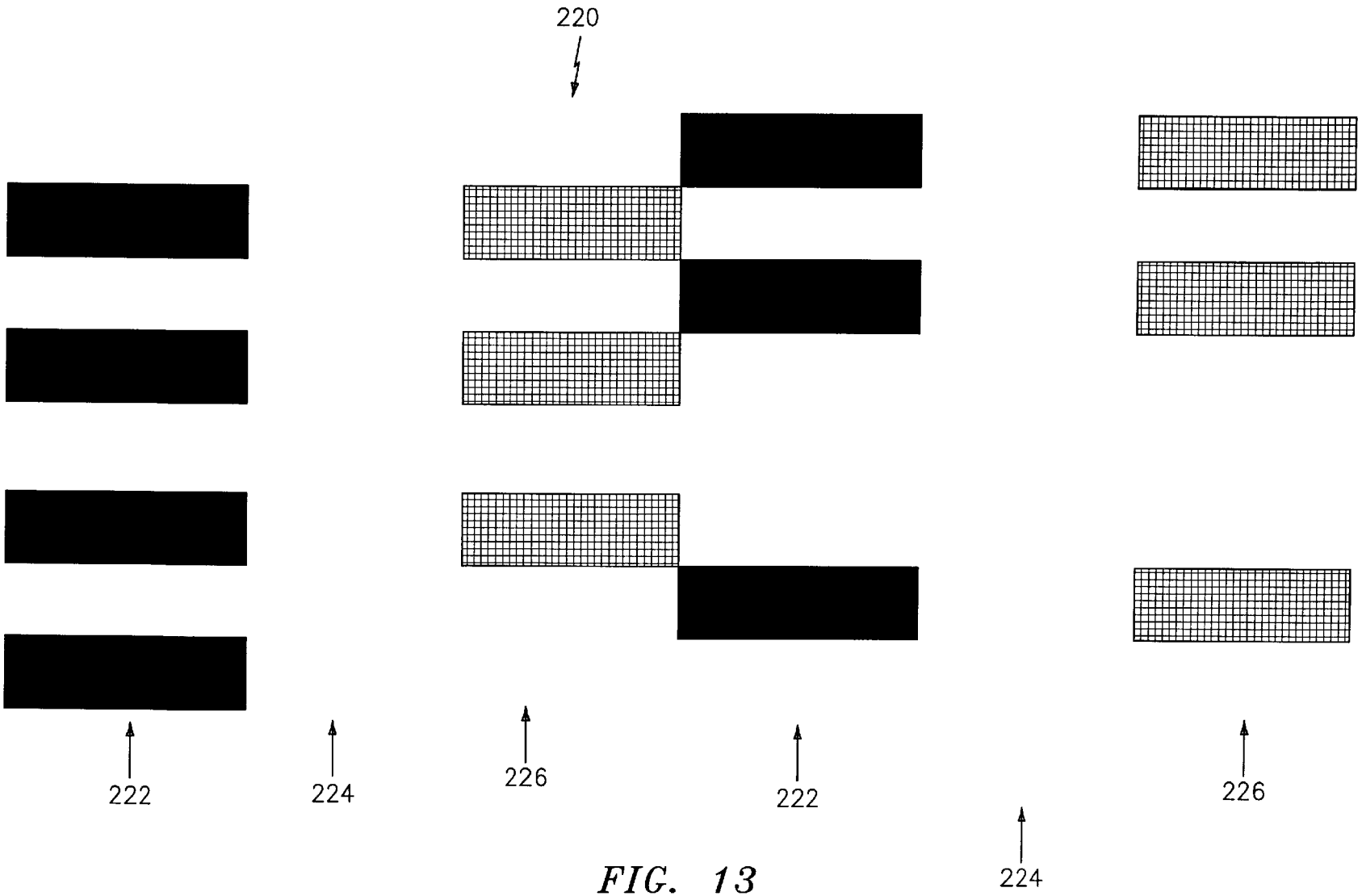
FIG. 13 is a copy of a printed set of calibration patterns useful in practicing certain aspects of the present invention related to use of an imaging array to determine head height and to render cartridge de-skewing information.
Figure 14A:
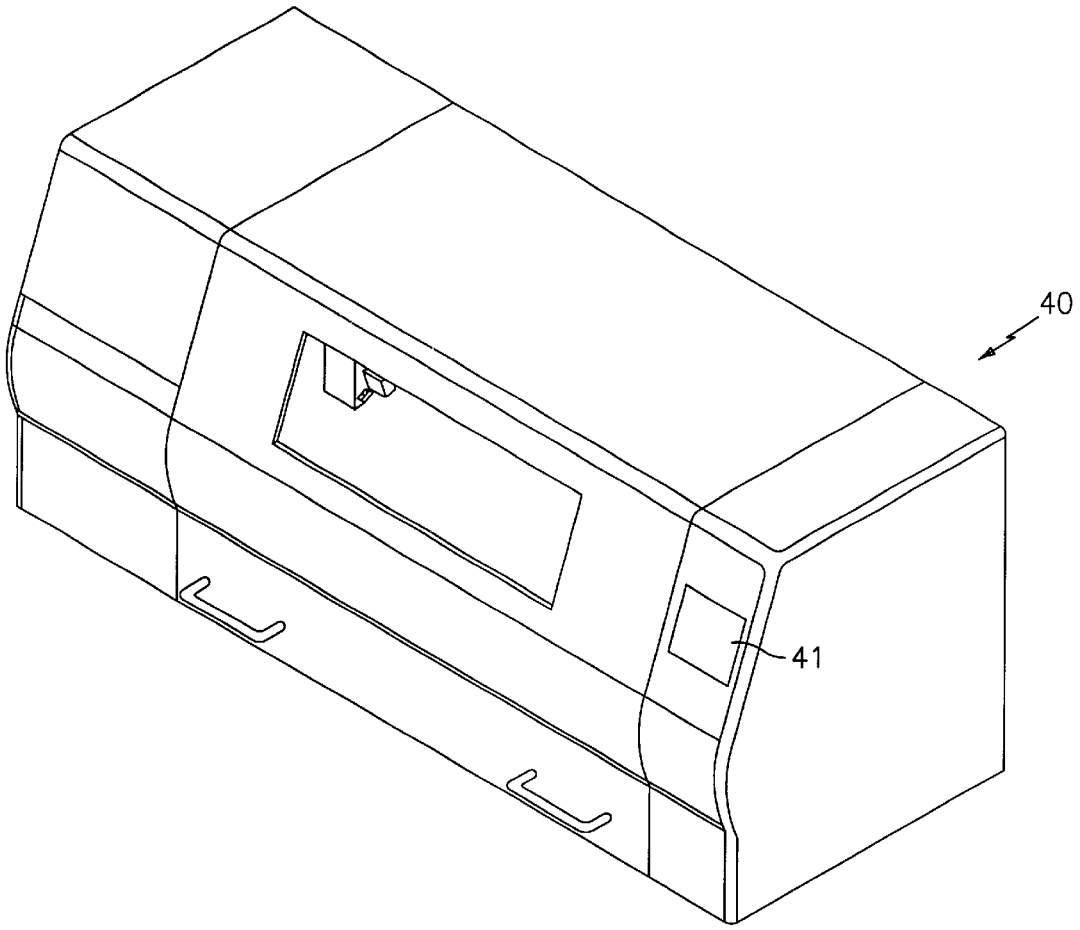
FIG. 14A and 14B depict perspective views of the enclosure of the print engine of the present invention in a closed and open configuration, respectively.
Figure 14B:
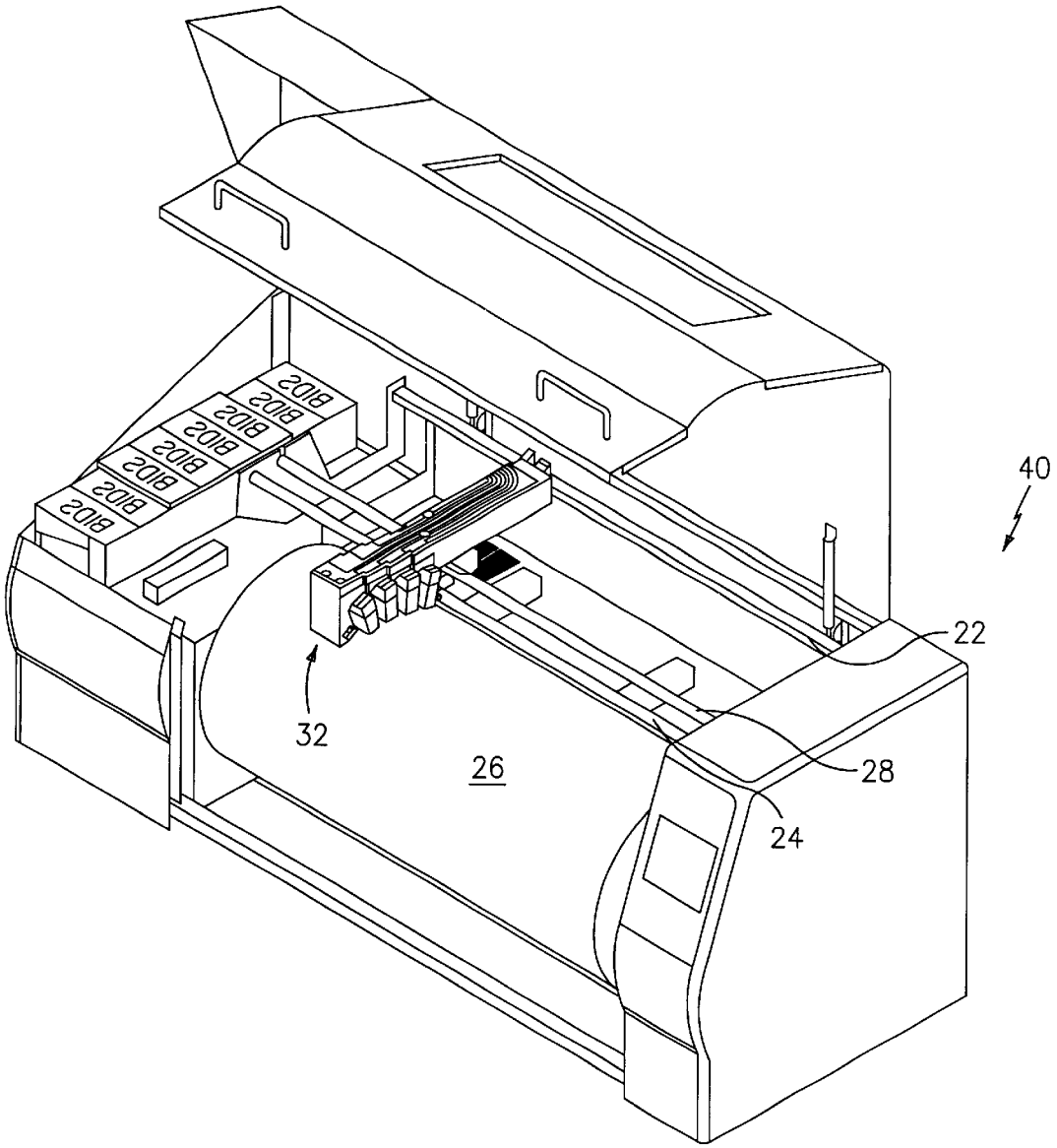
Figure 15:
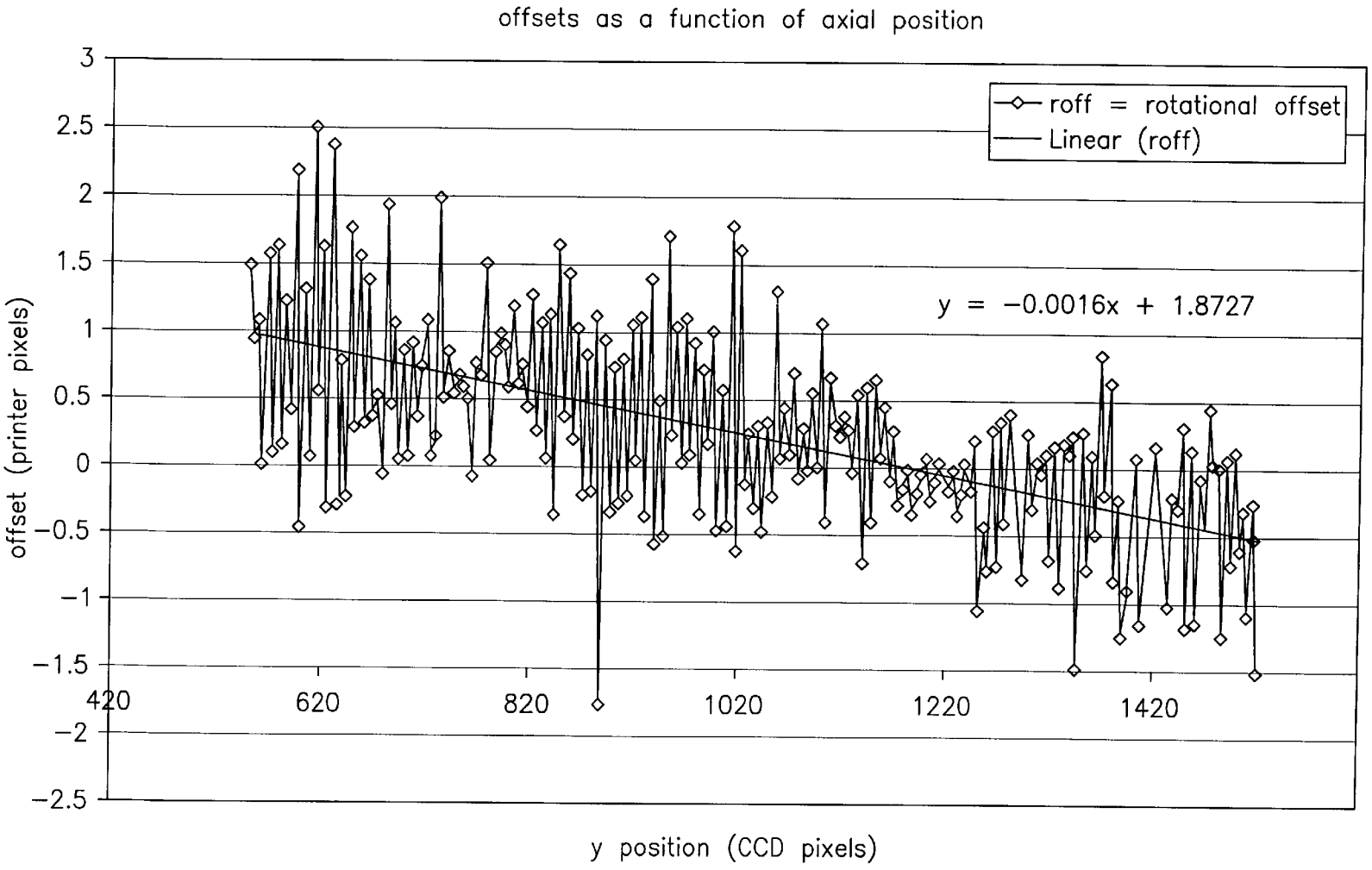
FIG. 15 is a graph of data used to correct skewing of a cartridge with respect to a portion of data captured by an imaging array showing rotational offset for a select subset of printed pixels.

In yet another preferred embodiment, an imaging array assembly 150 with LED's of selected values disposed around the periphery of the array 150. The array 150 may be a linear or two-dimensional array and is preferably disposed on a lower portion of said carriage assembly 32 proximate a printing substrate attached to the drum 26. The imaging array 150 is electrically coupled as described in detail in co-pending U.S. patent application Ser. No. 08/922,297 (filed Sep. 3, 1997); owned by common assignee ColorSpan Corporation (formerly known as LaserMaster Corporation) of Eden Prairie, Minn., and entitled "Method and Apparatus for Registration and Color Fidelity Control in a Multihead Digital Color Print Engine." The contents of said patent application are hereby incorporated in their entirety herein as if fully set forth herein. While this reference reveals in detail the operational considerations for an imaging array attached to a roll-fed large format carriage printer, all said teaching applies to the instant drumbased print engine. For present purposes the imaging array is preferably positioned between a preferred v-shaped plurality of print head sockets 58 at either or an adjustable height relative to said ink emitting surface, or orifice plate. The imaging array 150 is used to detect marks of calibration patterns 220 (see portions 222,224,226, of FIG. 13) and possesses a native pixel size and forms a corresponding bitmap image when scanned across, or disposed opposite, marks formed by ink droplets from the print heads 50. Assuming a nominal diameter of said marks, a correlation between the number of imaging array pixels that comprise a discrete mark and head height can be determined. In addition, due to the fact that the imaging array is fixed with respect to the carriage 32 and rails 22,24 of the printer 40 (in the x-y plane) the bitmap image captured can be accurately analyzed to determine the degree of skew, or the saber angle, between a given print head 50 and one or more other print heads with reference to a parallel reference (using the fixed relationship of imaging array 150 the carriage and rails of the engine 40. The bitmap is analyzed and a correlation located with respect to an ideal printout. Then each dot of the pattern is analyzed to determine rotational and axial errors from the ideal. When the axial offset is versus rotational offset produces a slope (that cannot be attributed to a consistent skew of the imaging array itself) a best fit routine will produce the skew of the cartridges. Then a correlation between a pitch of a threaded set screw disposed against an angled surface (and biased with a spring) will urge each cartridge to pivot to a desired de-skewed position. The imaging array 150 typically is first tested to confirm it is operating within parameters with a simple white-point/black-point pattern 222 signal comparison (to confirm signal strength of the array). The imaging array is preferably surrounded by sources of visual radiation (LED's, optical fibers, lasers, operating in the visual spectrum) to maximize the signal returning therefrom. Then, after allowing time for ink to dry, and setting a drum brake (not shown) by switching a solenoid switch (not shown), one or more searching techniques can be used so that the array "intercepts" one of a plurality of calibration patterns 220 (see FIG. 13 printed on a selected printing substrate and either provides feedback on its signal output or passes said signal output to comparator circuitry for analysis. Herein, scaling marks 226 are inspected (following confirmation of signal strength) to accurately gauge the distance separating the focal plane of the imaging array 150 and the printing substrate this distance can be determined in a variety of ways (e.g., focus imaging array on the periphery of scaling pattern marks and determine head height by applying a ratio of the number of imaging pixels of the array 150 to each dot-shaped mark on the printing media. Then, given a known linear separation between the plane of the ink emitting surfaces of the print heads and the focal plane of the imaging array the height of the ink emitting surface over the printing media can be ascertained. The testing and calibration pattern depicted in FIG. 13 are created by energizing the individual ink emitting nozzles, or jets, while the carriage assembly 32 remains motionless and the drum 26 rotates (four turns for the patterns depicted). Then, a solenoid switch (not shown) is activated to release a drum brake (not shown) that forcefully engages a lateral non-printing surface of said drum element so that the carriage assembly 32 may slew back and forth to register and calculate values of print head skew, or saber angle, as more fully described hereinbelow (by inspecting pattern 226). This Figure also depicts the limited axial separation, or footprint, of a preferred print head orientation for the present invention.

Another embodiment of said head height adjustment technique useful for simply avoiding detrimental "head strikes"(i.e., contact between the ink emitting surfaces and the printing substrate) as opposed to optimizing said head height parameter as in the foregoing discussion, can be implemented as follows: a first head height separation setting is input to the printer 40 so that a nominal head height, or home position is achieved (either independently or in reference to a published manufacturers media thickness measurement) and single pass, or slewing operation, of the carriage assembly 32 occurs. While the carriage assembly 32 slews laterally, instantaneous axial location information (from a linear optical encoder as is known in the art) and instantaneous drum-rotation velocity information is correlated from a rotary encoder (not shown) optically coupled to a low torque motor 42 driving a belt 45 to gear 46 to rotate the drum 26 so that each head strike event can be recorded as a momentary discontinuity or alteration of the control loop signal. Then, as head strikes are detected, the head height spacing, or gap, is adjusted upward until no further head strike events are recorded. After the carriage assembly 32 has traversed the entire printed area of the printing substrate it is returned to its original position in preparation of subsequent printing passes over the same printing media. Note that creases, adhesive tape, wrinkles, etc. unique to each piece of printing media may require a head strike clearing scan of the carriage assembly 32 prior to performing every print. The repeatable "home" head height position is preferably preset when the printer 40 is manufactured so that printer initialization and calibration can proceed accurately during the life of the printer. This home position is set as follows. A stepper motor 101 attached to the upper "saddle" portion 107 of a vertically articulated part of the carriage assembly 32. The motor 101 drives a threaded shaft 104 coupled to a threaded nut 102 mounted to the lower half of said articulated saddle 107. A series of hard stops 105 are provided at locations of maximum desired upward travel of said saddle 107. Thus, the home position is found by activating the stepper motor 101 until hard stops 105 retards the upward progress of the saddle portion 107, then preferably approximately sixty (60) mils of travel downward for the saddle portion 107 is completed, then a final upward movement of about twenty (20) 20 mils is applied—to remove all backlash from the system—and the "home" position is found. This home position is set at a relatively safe separation that will provide high quality printing in the event that one or more of the head height adjustment components later becomes inoperative. While not depicted herein a similar articulated motion (but this time a pivoting motion not a linear translation as with the stepper 101) of a lateral portion of the carriage can be used to correct any yaw, or sideways angle of the carriage.

Figure 9:
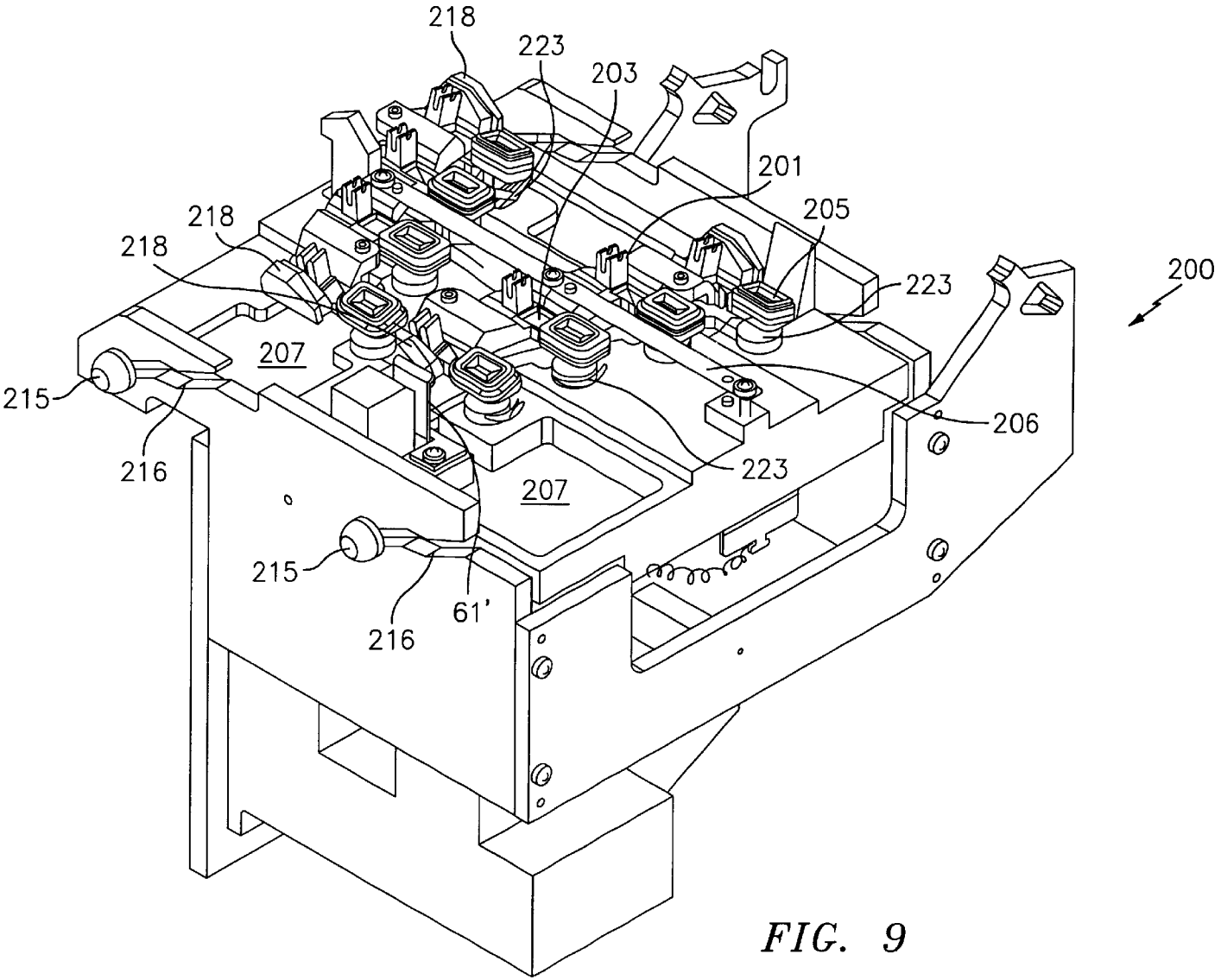
FIG. 9 is a perspective view of a service station assembly taught herein depicting a slideable service station assembly and associated service function locations thereon.
Figure 10A:
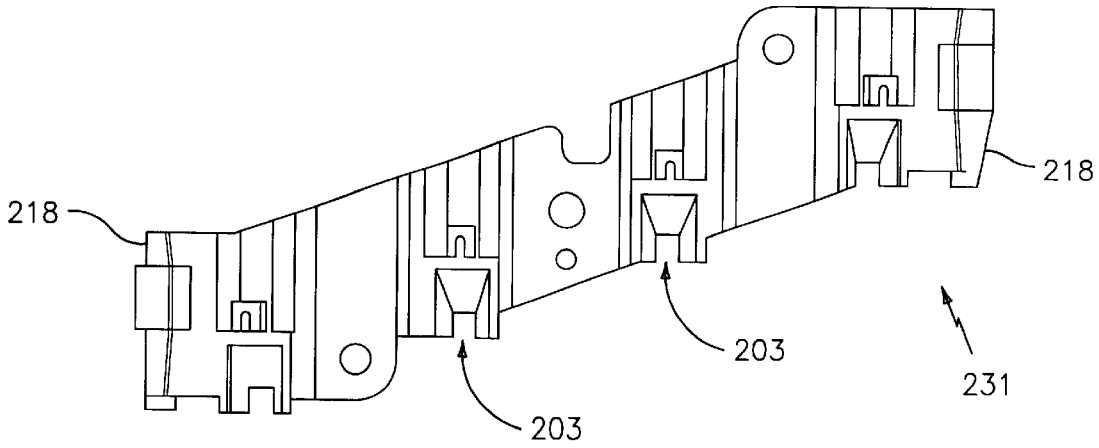
FIG. 10A and 10B depict plan views of the service station plates with the wiping and spitting sub-stations clearly illustrated, as well as the guideposts for ensuring alignment of the cartridges and said sub-stations.
Figure 10B:
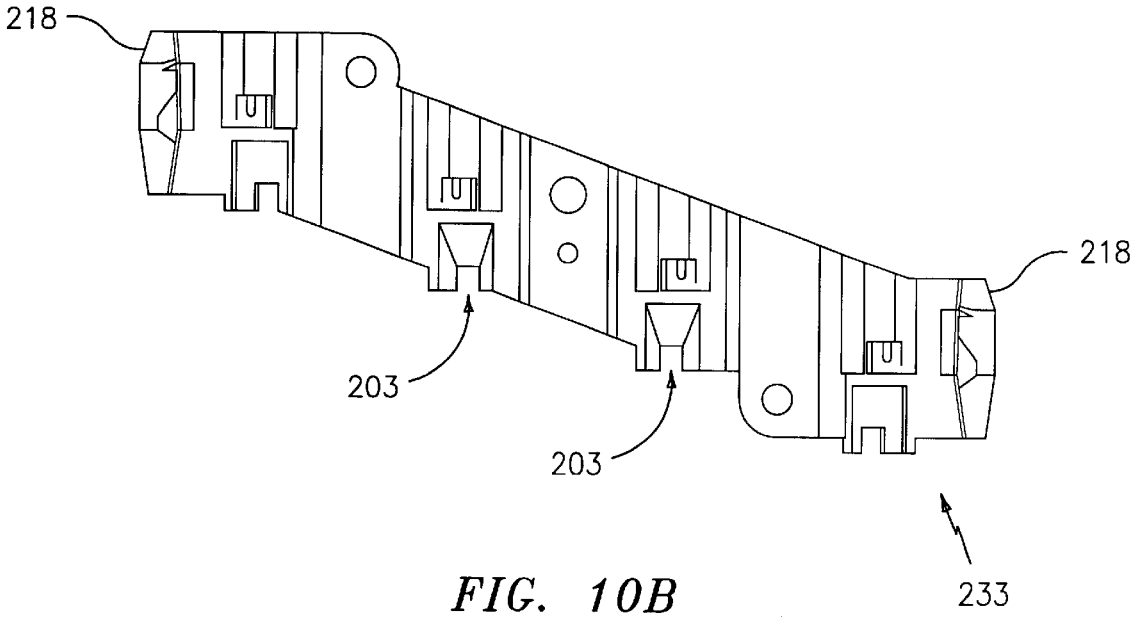
Figure 11:
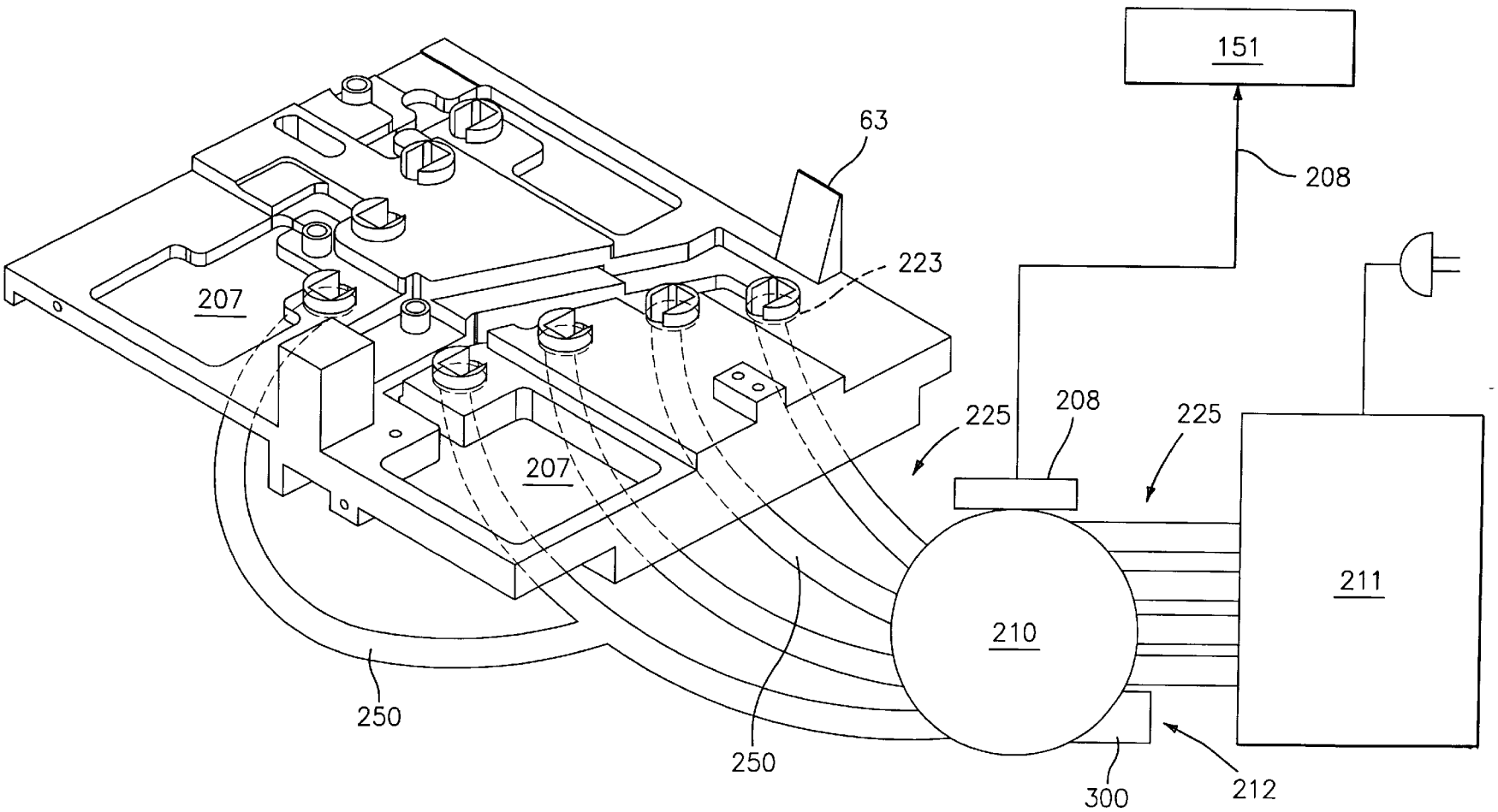
FIG. 11 is a perspective view of a ducted plenum assembly which is used to convey a source of vacuum through a valved control device and to an accumulator vessel that is usable with the present invention.

With respect to the service station assembly 200, as can be seen in FIGS. 9, 10, and 11, each ink emitting surface of each cartridge 50 has a corresponding service location (provided with independent suspension for each cartridge) of three stations of said service station assembly; namely wiping, spitting, and capping sub-stations. In a preferred embodiment, the capping station is coupled to a source of relative vacuum 211 (preferably Hewlett-Packard Company part #C3195-60059 primer assembly with a 3.5 p.s.i. maximum) operating to provide approximately 1–2 p.s.i. which fluidly couples to an accumulator vessel 210 wherein excess ink material can be eliminated by evacuation, venting, boiling, or drying. This process allows a large volume of ink to be removed including material that themselves plug an ink emitting orifice, or can later form "soft plugs" if left unattended, as is known in the art. In a preferred embodiment, The accumulator vessel 210 is used intermediate of said source of vacuum 211 and said print head cap mounts or mounting bosses 205 and said accumulator vessel 210 can be outfitted with a drain member 212 to protect the source of vacuum pressure and a float valve 208 (having output signal means for providing an output warning signal 208'—optionally to remove display apparatus 151) so that an electric signal may be initiated when the vessel 210 is nearing capacity. In the preferred embodiment having eight print heads 50 the source of vacuum 211 is provided with a plenum assembly 225 that directs the source of vacuum 211 from its original four ducts advantageously to all eight cap stations or mounting bosses 205 for each of the eight print heads 50. The plenum assembly 225 preferably includes at least one length of flexible tubing 250 that is capable of fluidly coupling at least one mounting boss 205 to accumulator vessel 210.

Figure 3:
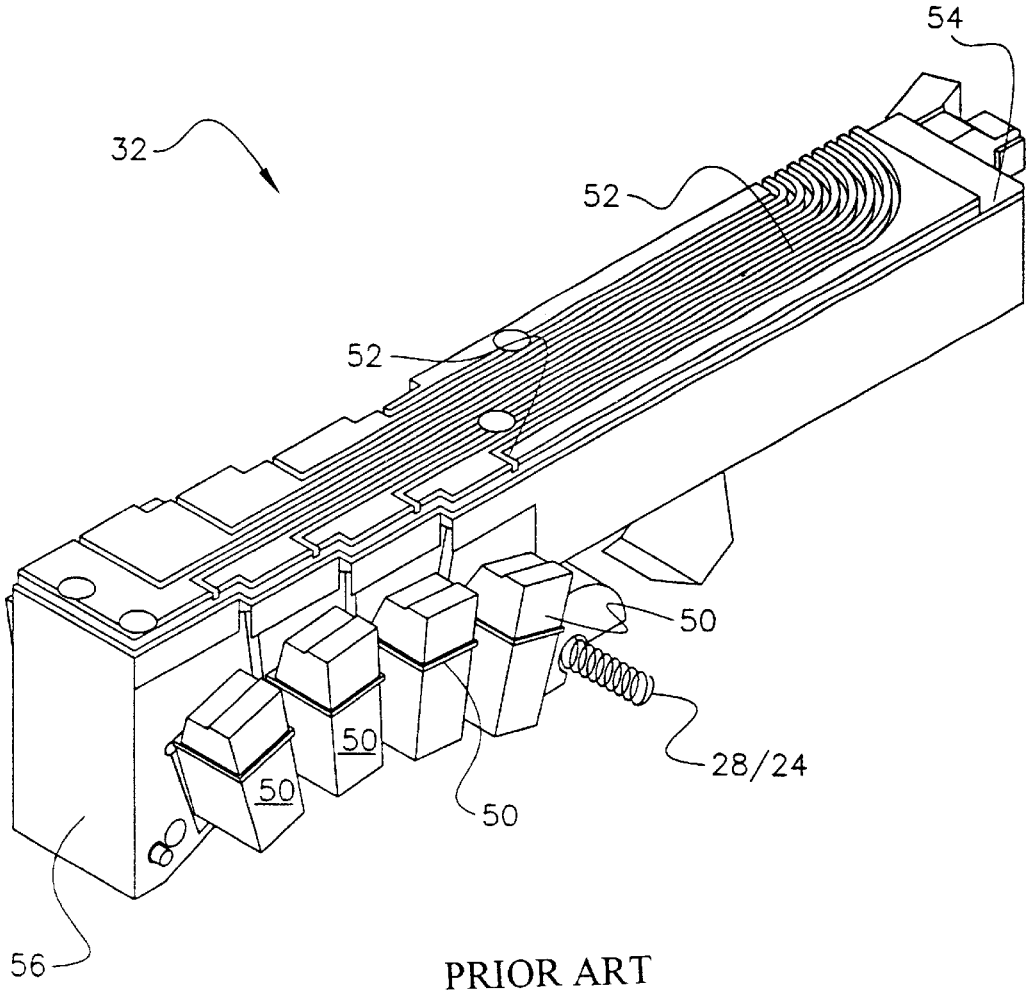
PRIOR ART Fig. 3
FIG. 3 is a perspective view of an embodiment of a prior art carriage assembly for releasably retaining eight ink jet cartridges in close proximity to a printing medium attached to a rotating drum member.
Figure 5:
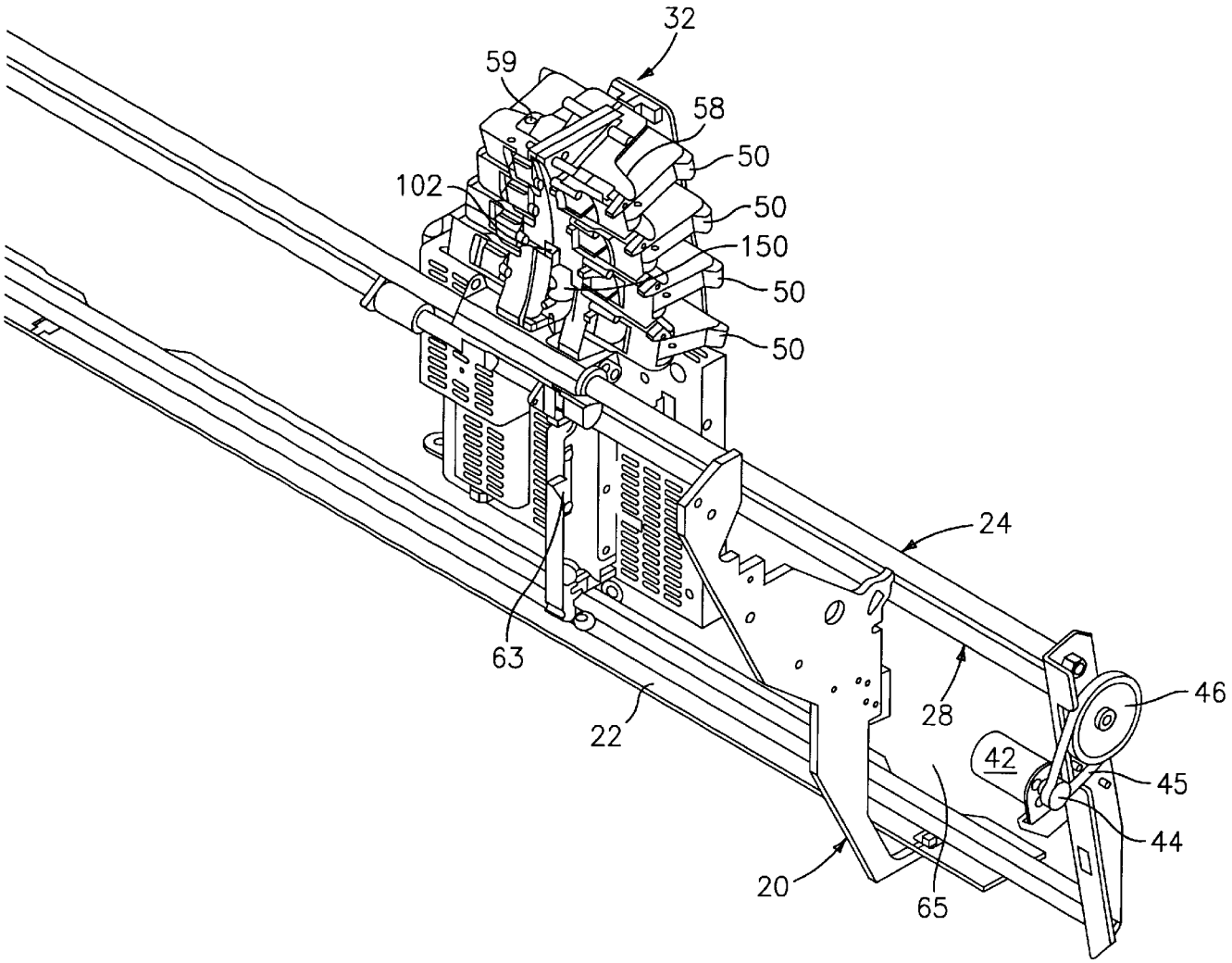
FIG. 5 is a perspective view of the carriage assembly depicted in FIG. 4 taken from a lower perspective to illustrate the lower portion of said carriage and the location of said imaging array.
Figure 6:
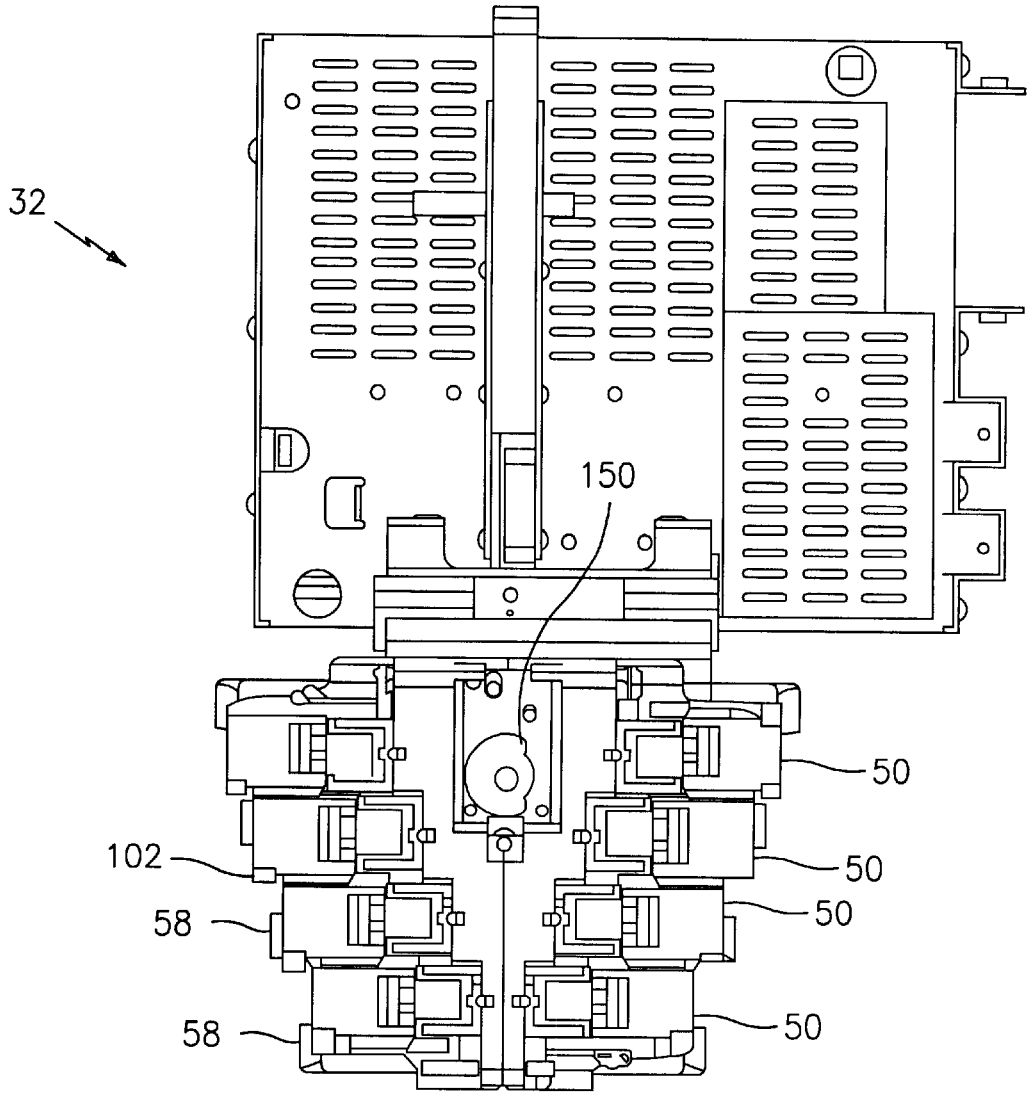
FIG. 6 is a plan view of the lower portion of the carriage assembly of FIG. 4 and FIG. 5 and illustrating the close spacing between eight print heads and an imaging array practiced in accordance with the present invention.

Referring to FIG. 3, depicting a portion of a prior art carriage assembly 32, including print heads 50 and ink tubing receiving grooves 52 formed into carriage top cap 54, and a lateral end cap 56 sealing the end of carriage assembly 32. As can be seen in FIG. 13, a perspective view calibration patterns 220 shows that no two print heads 50 operate to print a common print swath (testing and calibration patterns 220 from said print heads 50). Thus, in a preferred eight print head embodiment of the carriage assembly 32 the print heads 50 disposed on a common side of the carriage 32 are minimally spaced apart from each adjacent print head 50 axially and in the lateral direction to minimize the footprint of the carriage assembly 32. Furthermore, as can be seen in FIG. 5, the print heads 50 are disposed spaced from one another circumferentially, so that each print head 50 maintains a common distance from the exterior surface of drum 26 which is of course cylindrical even when the head height is adjusted. In a preferred embodiment, the entire articulated saddle portion 107 of the carriage assembly 32 pivotably attaches to an threaded attachment point where a threaded bore 102 meets a threaded stepper axle 104 driven by a stepper motor having a native axial resolution of approximately 0.5 mils. This attachment point is furthermore preferably an electrical stepper motor 101 operated from a remote touch pad, or console 41 on a surface of the printer 40 for ease of control by an operator to elevate and lower the saddle portion 107 of the carriage assembly 32, and thus the ink emitting jets, approximately ¼" (to desired or optimum spacing above a selected printing substrate). The articulated attachment point could comprise a variety of devices, including a manually operated set screw, a ratchet assembly, or a bushing etc. and should have a home position or set point easily repeated after long use.

In a further preferred embodiment, another articulated attachment point is advantageously employed at one or more cartridge mounting sockets 58 so that one or more of said cartridges (or print heads) 50 can be skewed relative to one or more of the other of said plurality of print heads 50 to enable certain specialized high speed print modes (typically having high slew-rates for carriage assembly 32) and to improve registration among two or more of said print heads that inadvertently contain a saber angle between the marks they produce on a printing substrate. In one embodiment, only those print heads containing ink particularly perceptible to a human viewer contain such an articulate attachment point, in another embodiment, more than one such articulated attachment point is provided so that a particular print head, or a bank or more than one print heads can be appropriately disposed relative to one or more of said plurality of print heads 50. In addition, more than one axis of rotation may be enabled with more than one set screw adjustment per cartridge so that three dimensional skewing, or alignment can be achieved between cartridges.

Referring to FIG. 5, with respect to the cartridge socket mounting surface 58, the print heads 50 are disengageably mounted onto their respective mounting location with a simple and effective three point retaining coupling. Three point retaining coupling consists of two foot members for receiving the corresponding two feet of a family of thermal ink jet cartridges manufactured by Hewlett-Packard, and known as model 51645 series, or family, or cartridges, and brethren using similar external bosses and mounting feet. The model 51645 print heads have 300 ink emitting nozzles per cartridge but only 224 are preferably used in conjunction with the present invention due largely to the difficulty of getting all the nozzles formed on the periphery of the orifice plate of said 51645 cartridges to reliably emit ink when energized. The inventors have discovered that such an engagement mechanism provides a stable and repeatable means of attachment without further adjustment or manual tightening by an end user. Furthermore, the inventors have further discovered that such a design offers economy of space since nothing protrudes beyond the outer surface of the cartridge 50 itself while mounted for printing operations. For reference, many prior art cartridge attachment means rely upon relatively more complicated and less robust designs to typically mount cartridge 50 so that an array comprised of a plurality of ink jetting nozzles (not shown) associated therewith are oriented parallel to the axial movement of a reciprocating print carriage operating in a drum-based large format digital print engine.

Figure 4:
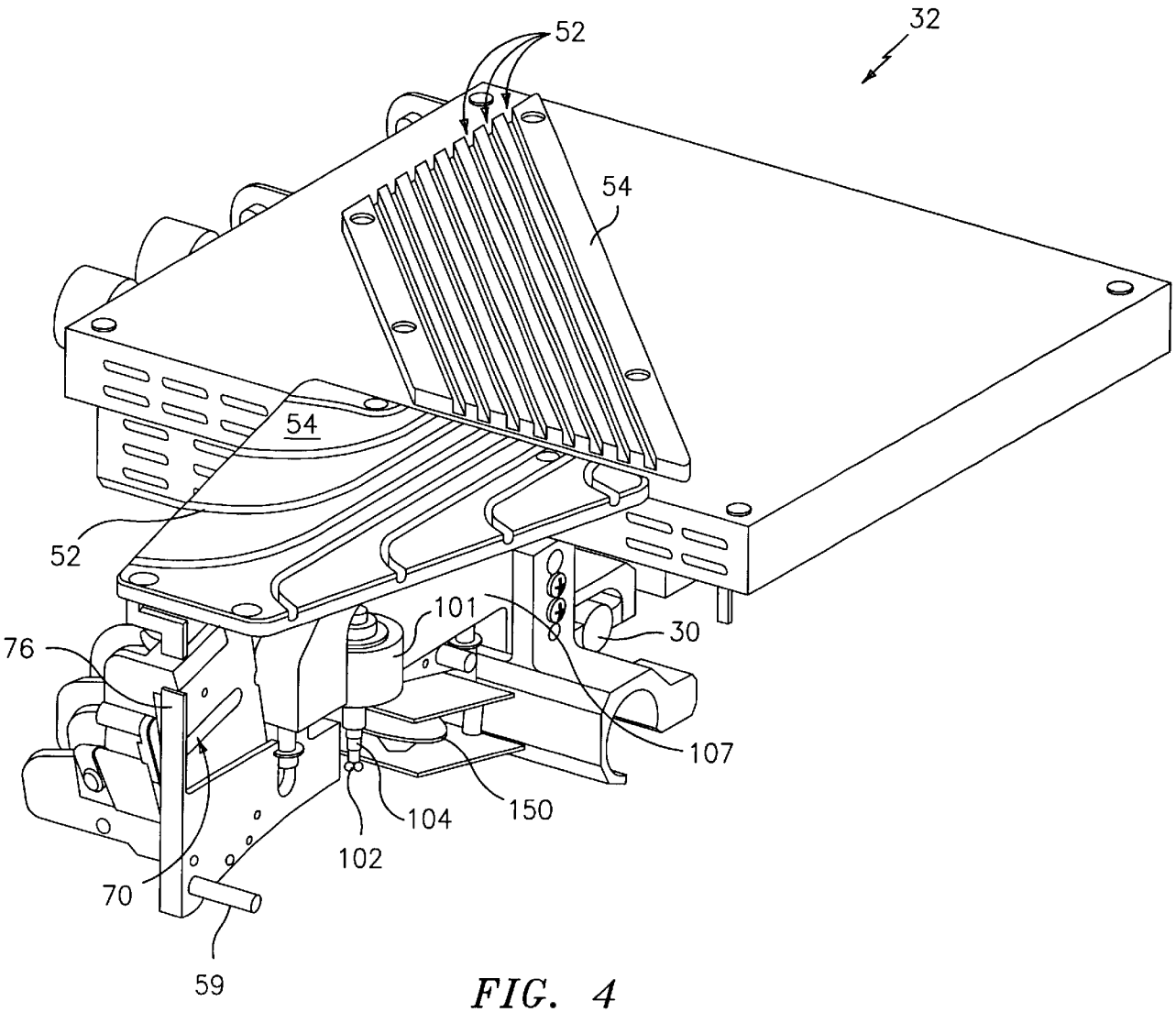
FIG. 4 is a perspective view of an embodiment of a carriage assembly made pursuant to the present invention for releasably retaining eight ink jet cartridges on an articulated saddle portion of said carriage in close proximity to a printing medium attached to a rotating drum member and depicting the location of an imaging array within said articulated saddle portion.
Figure 7:
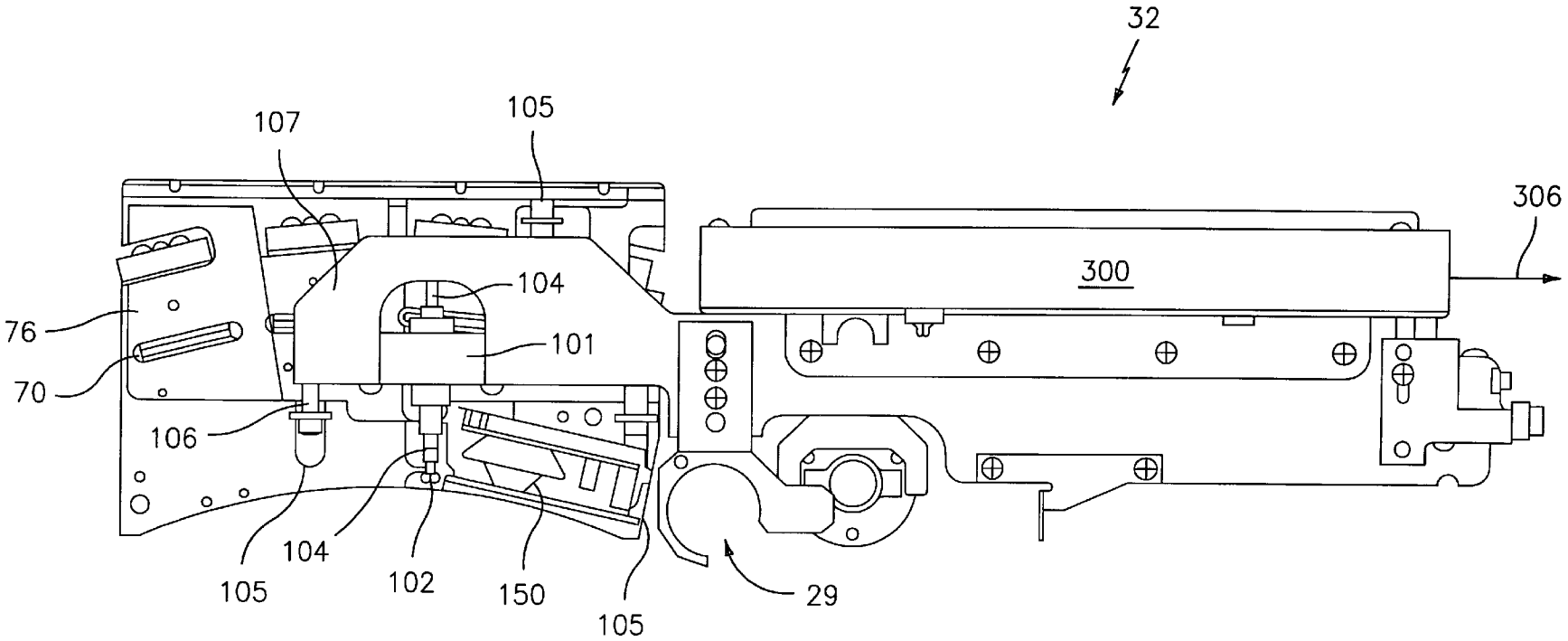
FIGS. 7 is an elevational side view in cross-section of a lateral side of an embodiment of the carriage assembly depicted in FIG. 5 and FIG. 6, showing details of the coupling points for the carriage to a slide rail and a driven lead screw, a stepper motor for vertically articulating the saddle portion of said carriage and the apertures for receiving flex cables to electrically connect to print heads disposed in print head sockets.

Referring to FIG. 7, which is also an elevational view in partial cross section along lines 5—5 of FIG. 4, of the full length of carriage assembly 32 apertures 70 formed in first carriage assembly structural member 76, admit electrically conducting flex circuits (not shown) to each of the print heads 50 at a first end and a second end terminates at circuit board 300 (not shown) disposed intermediate the two carriage assembly structural members forming articulated saddle portion 107 of carriage 32, and line 306 electrically couples to remove circuitry.

Figure 8:
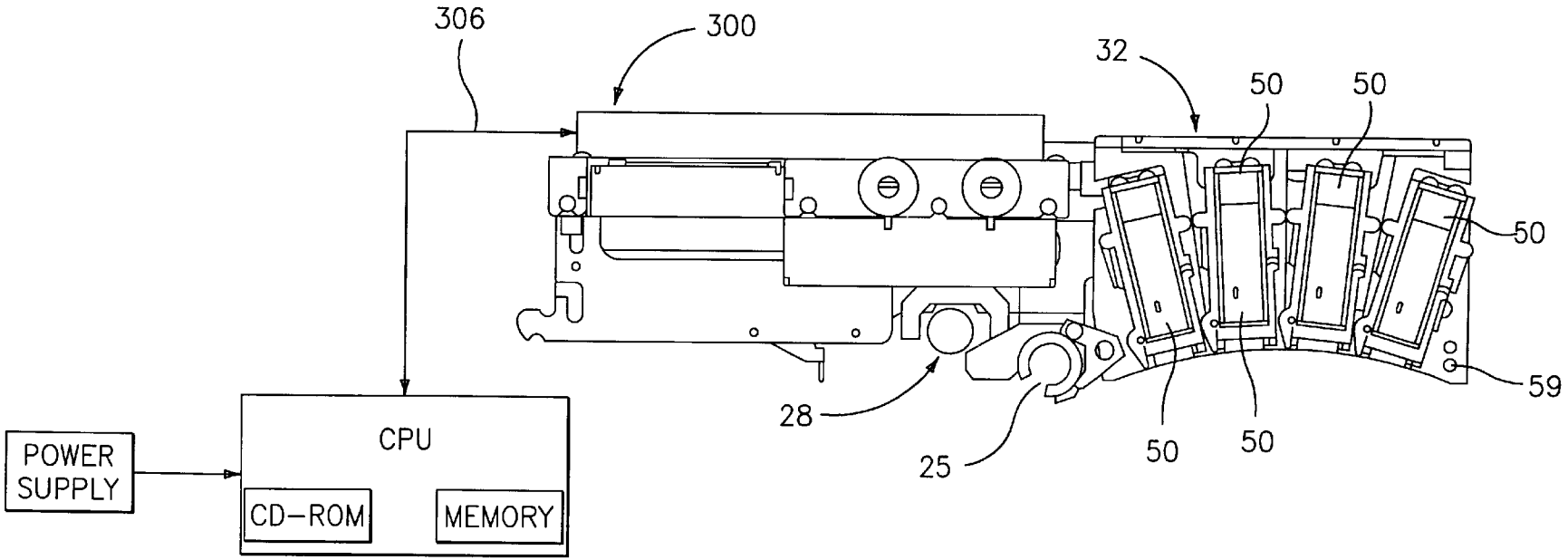
FIG. 8 is an elevational side view of a lateral side of an embodiment of the carriage assembly depicted in FIG. 5 and FIG. 6, showing details of the coupling points for the carriage to a slide rail and a driven lead screw, line traces representing electrical and electronic communication between printer circuitry, head board circuitry, and four print heads disposed in print head sockets along one side of said carriage assembly.

Referring to FIG. 8, the coupling of carriage assembly 32 to heads 50 is illustrated in an elevational view of an embodiment of the rails and connection pins to drive carriage assembly 32 axially along the shaft rail 24.

A spring loaded cartridge maintenance location, service station assembly 200, is disposed at one end of the rail operates to perform wiping, spitting, and capping functions to the ink emitting nozzles of the cartridges 50 so they perform within specification. The service station assembly 200 was designed with a minimum of moving parts, and is actuated by passively receiving a boss-shaped datum 59 located at a proximal end of the carriage assembly 32 with a tab 61' disposed adjacent to block-shaped member 61 so that the datum 59 is retained therebetween, thereby further promoting field service efficiency and precision alignment with a minimum of critical alignments. With reference to FIG. 9, depicting a perspective view of an embodiment of the service station assembly 200 having three main functional areas: spitting area 203, wiping area 201, and capping area 205 having a radius similar to the radius for the cartridges 50 with respect to spatial orientation. Each mounting boss 205 is provided with a spring-biased base section 223 for promoting a firm seal around the periphery of each group of nozzles of each cartridge 50. In operation, a lower rib portion of cartridge 50 (proximate the jets) meets guide posts 218 which acts as extremely accurate guidance vehicles for alignment of the cartridges 50 during service station operation. The guide posts 218 ensure an initial proper axial alignment of the wiper elements 201 and spitting aperture 203 with respect to the cartridges on the carriage assembly 32. The frame member 220 thus mechanically articulates on a parallel axis to the axis of lead screw 28 so that after momentarily aligning an ink receiving vessel with the ink emitting nozzles of each row of print cartridges 50, a short segment of double-finned wiper armature 201 clears ink from the surface of the nozzles. To maintain the spatial orientation of the left and right array plates 231, 233 with a minimum of additional components a strap member 206 couples to both plates 231, 233 and to the upper portion of the service station assembly 200 and springs underneath (not shown) provide a degree of freedom. Thus, the guide posts 218 of the plates 231, 233 provide affirmative contact with a portion of the print heads themselves to ensure accurate alignment during wiping and spitting operations. Note that the carriage assembly 32 need not reverse direction so that the second set of cartridges 50 receive the same treatment as the first set of cartridges 50. Then, the carriage 32 preferably translates the service station sub-assembly 207 laterally on pins 215 which engage rising surface 216 to promote sealing connection between mounting bosses 205 and cartridges 50 (with approximately eight pounds of force—thereby necessitating the dual, spring biased rollers at the distal end of carriage 32 earlier noted). A source of vacuum 211 is ported via plenum assembly 225 to a lower port formed below the mounting bosses 205 and said vacuum is applied for a fraction of a second which is long enough for ink to be removed from the ink emitting nozzles. This ink material is preferably routed to an accumulator vessel 210 outfitted with a float valve 208 which provides a signal (on line 208') to processing electronics, and optionally to a monitor means 151, when the vessel is nearing capacity. In addition a drain member 212 can be coupled to the vessel 210 so that the source of vacuum 211 is protected from over pressure conditions. Preferably the drain member 212 is a check valve 300. Following the evacuation of ink from the ink emitting nozzles, the print heads 50 continue to engage the mounting bosses 205 of said service station assembly 200 where they remain prepared until a next required printing operation or for manual replacement with a different set of marking materials by the operator. In designing the service station assembly 200 of the present invention, the inventors consulted and considered, among other things, capping station pressures, evaporation rates, and other criteria for designing the capping station, including a psychometric chart (used in evaporation calculations), and tolerance stack-up allocation for components.

In one embodiment of the present service station assembly 200, a tab 63 formed on a lower portion of carriage 32 is oriented so that said tab 63 trips a split sensor 65 as the carriage prepares to enter the service station zone (thereby indicating the location of the carriage assembly). This split sensor 65 provides the location to carriage control circuitry so that the drive screw 28 may operate at its maximum torque setting to drive the service station into sealing contact with the boots. Also, to aid the low torque motor 42 in efficiently performing service station functions, the vertically articulated saddle portion 107 of the carriage assembly 32 which retains the print heads 50 can be raised slightly to thereby reduce the force needed to cap the nozzles of print heads 50. As can be appreciated, the print engine of the present invention operates independently of absolute carriage and print head position sensing or calculation. As a result this split sensor 65 provides a location signal of adequate resolution for the accurate control of the carriage during the initial phase of a service station visit.

A preferred method of manufacture of a drum member 26 usable with the present print engine 40 is detailed in the applications referred to above. The reader is encourage to review the disclosure therein for a fuller understanding of the design considerations and criteria for the present drum member. A current embodiment of a drum subassembly 26 useable with the present invention basically consists of a resin-based, or plastic, sleeve bonded to two endcaps with total indicated run-out ("TIR") of not more than 0.005" over the entire surface of the drum, and a static balance of not greater than 0.8 inch lbs, and a diameter of the drum or 15.900"+/−0.005" and a width of 36.25"+0.040"−0.000" and a torque rating during printing operations one (1) inch ounce maximum.

Rotary encoder assembly used herein preferably employs a one thousand (1000) counts per revolution optical chopper—a part customized for the print engine described herein although quite similar in some respects to Hewlett-Packard 6000 Series three channel optical encoder reader. Since these types of encoders are well known in the art, no further discussion of the encoder follows.

The drum 26 is driven about its axis of rotation by a pulley subassembly coupled to a simple low torque electric motor residing in an enclosed space so that only a drive wheel protrudes into a printing bay of the engine 40. The belt driven between the motor and a driving surface on an end of the drum preferably is a timing-type belt with geared teeth to reliably engage the drive wheel of the motor. In order to further control tolerance stacking and creep, a variety of drum drive belt stretch test data was captured so that a predictable amount of wear and stretching of the drive belt can be tolerated by the printing engine. Since the rotation of the drum and the drive screw are independently operated, and the precise control and stability of both directly impact the accuracy of the final printed output, very little stretch can be tolerated, and therefore the belts have a recommended replacement frequency that ensures the desired quality of printing.

The drum member is preferably statically and dynamically balanced. First of all known static balancing techniques ensure that the drum is balanced at rest. Then the drum is rotated to a stable rotational velocity and torque measured at various periods of time. As is known in the art a plug of material is typically added so one or both lateral sides of the rotary drum member so that undesired vibration during rotation is eliminated.

While the present invention has been described with reference to certain embodiments, it is clear to one of skill in the art that various other embodiments and changes of form shall are covered by the spirit of the invention and as such shall be considered part of the invention as particularly claimed in the following claims, which alone define the metes and bounds of the invention herein disclosed, enabled, and taught.

For example, the extremely robust three point stand of the print head of the present invention can be adapted to carry a large variety of additional equipment, including bulk ink reservoirs associated with extended ink supply systems referenced above as well as fans, heaters, and other means of drying the printed materials.

The selection of materials for the components described herein can be varied, but preferably the vertically articulated saddle portion 107 of said carriage assembly 32 is preferably formed of aluminum, the drum of PVC, and the chassis for the printer of either metal or resin. The useful range of the head height adjustment described herein has been estimated at approximately one-quarter inch (0.25"). The output from the imaging array 150 can be ported to a display means 151 located on the printer itself, to a remote monitor, both, or neither, since the image capture does not generally require human interpretation. The manner of dot detection used with said imaging array can be based on the periphery of a dot, the calculated "center" of a dot, an arbitrary weight associated with each pixel element of the imaging array, or other methods as known in the imaging art. The degree of print head skew with respect to a given print head can be determined with reference to a variety of sources, including a logical co-axial vector parallel to the direction of print head slew, or simply from the relative reference frame of the field of view of the imaging array 150 since said field of view (and therefore "skew" of said imaging array) is relative for all print heads inspected by the same imaging array. The useful range of skewing of a print head has been determined to be about sixty mils (0.060") at a point remote from a pivot location of said model 51645 print head, although the location of the set screw and the type and size of print head will dictate other possible combinations that can be reliably correlated to a skewing angle of said print head for compensation purposes. The values of head height, encoder counts per unit of carriage slew, home head height, skewing angles of the print heads and other operating values of the printer are preferably stored in a flash-type memory so that they can be reliably retrieved even after long periods of printer inactivity.

What is claimed is:

1. A large format ink jet printer comprising:

a first alignment support plate and a second alignment support plate spaced apart from the first alignment support plate;

a bar rail and a shaft rail, both of which are suspended between the first and second alignment support plates;

a lead drive screw rotatably mounted and suspended between the first and second alignment support plates;

a linear actuator assembly engaged with the lead drive screw such that as the lead drive screw rotates, the linear actuator assembly is propelable along the lead drive screw;

a service station assembly coupled to at least to one of the first and second alignment support plates and disposed in a service station operating zone located proximate a printing zone wherein the service station assembly comprises a service station subassembly itself comprising a set of mounting bosses, wherein each mounting boss has associated therewith an independently biased cartridge sealing member;

a reciprocating carriage assembly means having a plurality of print heads and being slidably suspended on the bar rail, the shaft rail and the lead screw drive, wherein the carriage assembly means is slidably driven along the bar rail and shaft rail by the propelling of the linear actuator assembly along the lead screw drive, the carriage assembly means for engaging said service station subassembly when the reciprocating carriage assembly means enters said service station operating zone to thereby move said service station subassembly along a linear access of reciprocation of the carriage assembly means;

wherein when the reciprocating carriage assembly means enters the service station operating zone, each of the respective independently biased cartridge sealing members are urged into sealed contact with each of the print heads.

* * * * *